US006532661B2

(12) United States Patent
Tsukada et al.

(10) Patent No.: US 6,532,661 B2
(45) Date of Patent: Mar. 18, 2003

(54) SHEET FEED SHAFT, APPARATUS FOR MANUFACTURING SAME AND METHOD FOR MANUFACTURING SAME

(75) Inventors: Sakae Tsukada, Ooizumigakuen-machi (JP); Eiji Tsukada, Ooizumigakuen-machi (JP)

(73) Assignee: Kabushiki Kaisha Tsukada Nezi Seisakusho (JP)

( * ) Notice: Subject to any disclaimer, the term of this patent is extended or adjusted under 35 U.S.C. 154(b) by 0 days.

(21) Appl. No.: 09/826,092

(22) Filed: Apr. 4, 2001

(65) Prior Publication Data

US 2001/0021684 A1 Sep. 13, 2001

Related U.S. Application Data

(62) Division of application No. 08/939,293, filed on Sep. 29, 1997.

(30) Foreign Application Priority Data

Sep. 30, 1996 (JP) ..... 8-278704

(51) Int. Cl.[7] ..... B21D 53/00; A01B 29/00

(52) U.S. Cl. ..... 29/895.31; 29/895.3; 29/23.1; 492/33; 492/36

(58) Field of Search ..... 492/30, 28, 37, 492/32, 31, 36, 33, 34, 35; 241/294; 29/895.3, 895.31, 895.32, 727; 83/879, 880, 881, 882, 883, 885; 72/76

(56) References Cited

U.S. PATENT DOCUMENTS

| | | | | | |
|---|---|---|---|---|---|
| 827,689 | A | * | 7/1906 | Francis | 492/3 |
| 1,681,875 | A | * | 8/1928 | Penney | 492/33 |
| 2,798,387 | A | * | 7/1957 | Woodworth | 72/76 |
| 3,285,046 | A | * | 11/1966 | Mellen et al. | 72/76 |
| 3,491,566 | A | * | 1/1970 | Hurd | 72/76 |
| 3,550,258 | A | * | 12/1970 | Odiorne | 29/895.32 |
| 3,746,086 | A | * | 7/1973 | Pasternak | 29/890.05 |
| 4,005,991 | A | * | 2/1977 | Uebayasi et al. | 428/609 |
| 5,376,410 | A | * | 12/1994 | MacKelvie | 427/290 |
| 5,971,638 | A | * | 10/1999 | Sato et al. | 492/31 |

FOREIGN PATENT DOCUMENTS

JP 8-86309 A * 4/1996

* cited by examiner

*Primary Examiner*—I Cuda-Rosenbaum
*Assistant Examiner*—Marc Jimenez
(74) *Attorney, Agent, or Firm*—McGlew and Tuttle, P.C.

(57) ABSTRACT

A sheet such as paper or a hard film can be fed accurately in an intended direction while positively holding the sheet merely by applying plastic processing to a peripheral surface of a metallic rod.

A plurality of spike-like projections A, B risen at an obtuse angle, at an acute angle or at right angles in a rotational direction of a metallic rod 1 are formed on an inner peripheral surface of the metallic rod 1 by plastic processing.

12 Claims, 25 Drawing Sheets

SHEET FEED SHAFT, APPARATUS FOR MANUFACTURING SAME AND METHOD FOR MANUFACTURING SAME

This is a Divisional of application Ser. No. 08/939,293 filed Sep. 29, 1997, and the entire disclosure of this prior application is considered to be part of the disclosure of the accompanying application and is hereby incorporated by reference therein.

BACKGROUND OF THE INVENTION

This invention relates to a sheet feed shaft used for a paper feed in a printing machine, a printer for an office machine and the like, and for a sheet feed such as a film in an overhead projector or the like.

A feed roller made of rubber has been widely used for a paper feed in a printer for an office machine. This tends to cause an unevenness in hardness of rubber, roundness, and concentricity with a shaft. Accordingly, in the case where multicolor printing is carried out by repeating the paper feed as in a color printing, a color deviation sometimes occurs due to the feed speed of paper and the deformation, and there occurs an inconvenience of unavoidably involving a change in quality and deformation caused by the wear of the feed roller.

On the other hand, there is disclosed, for example, in Japanese Patent Laid-Open No. Hei 7 (1995)-267396, a sheet feed shaft in which a metallic roller as a feed roller is integrally provided on a metallic shaft, a nickel plated layer is applied thereto, and after that, a sand blast processing is applied to the nickel plated layer of the metallic roller to make the surface a roughened surface.

According to the aforementioned publication, the roundness of the metallic roller can be secured and there occurs no wear or deformation. This can be therefore used as a multicolor roller.

However, in the conventional sheet feed shaft as described, since a number of hard small projections made of metal are formed on the surface of the feed roller, paper or sheets in contact therewith can be fed with high frictional resistance and in addition, the feeding can be secured for a relatively long period. However, since the small projections are relatively fine, there poses a problem in that dust stays between the small projections, the wear gradually progresses due to the feed operation so that the surface of the roller is gradually changed into a smooth surface, resulting in unusable.

Particularly, in the case where a sheet to be fed is a relatively hard film used in an overhead projector, there poses a problem in that the wear of the roller surface is particularly remarkable and cannot be fit for use for a long period of time, as a result of which the film cannot be arranged in an accurate position (on a light illuminating surface) so that a projected image is inclined.

There is a further problem in that the necessity to form a nickel plated layer or to apply a surface roughening by sand blast in order to form small projections on the metallic roller increases the number of processes and increases the cost of products accordingly.

SUMMARY OF THE INVENTION

This invention is to solve the problems as noted above. An object of this invention is to provide a sheet feed shaft, which can, merely by plastic processing with respect to the peripheral surface of a metallic rod, feed paper or a sheet such as a hard film in an intended direction while maintaining an accurate position thereof.

It is a further object of this invention to provide an apparatus for manufacturing a sheet feed shaft which can manufacture, at a low cost, a sheet feed shaft having spike-like projections with high feed or film feed effect by the use of a simple perforating means.

It is another object of this invention to provide a method for manufacturing a sheet feed shaft in which a number of spike-like projections with high feed or film feed effect are formed at a time on the outer periphery of a metallic rod quickly and simply by the perforating processing making use of a press.

For achieving the aforementioned objects, according to the present invention, there is provided a sheet feed shaft in which a plurality of spike-like projections which rise at an obtuse angle, at an acute angle or at right angles in a rotational direction of a metallic rod are formed by plastic processing on the circumferential surface of the metallic rod, said projections being provided in the entire axial direction or in plural areas of the metallic rod.

The apparatus for manufacturing a sheet feed shaft according to the present invention comprises a support bed for supporting a metallic rod, and a punch unit arranged opposite to the support bed to be reciprocated by a press, wherein a pair of perforating members having perforating edges formed on faces opposed to each other are mounted detachably on the punch unit.

Further, a method for manufacturing a sheet feed shaft according to the present invention comprises: supporting a metallic rod on a support bed, and simultaneously applying a perforating processing to two portions in which peripheral surfaces of the metallic rod are opposed by a perforating member formed with perforating edges on faces opposed to each other to form a plurality of spike-like projections whose rising directions are contrary to each other.

DESCRIPTION OF THE PREFERRED EMBODIMENTS

Figure 1:
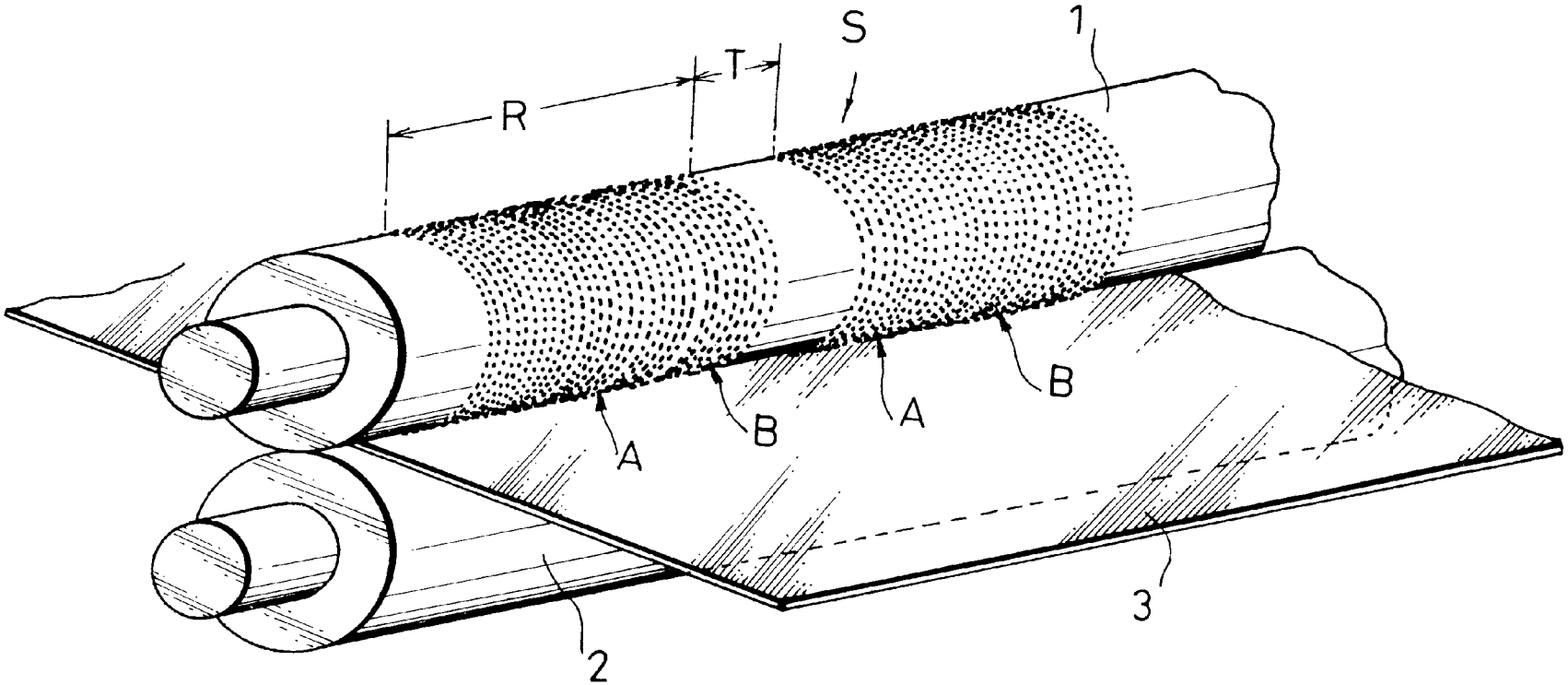
FIG. 1 is a perspective view showing a sheet feed shaft according to an embodiment of the present invention.

One embodiment of this invention will be explained hereinafter. FIG. 1 is a perspective view showing a principal part of a paper feed apparatus having a sheet feed shaft according to the present invention. In FIG. 1, symbol S designates a sheet feed shaft formed from a metallic rod 1, and numeral 2 designates a feed roller made of hard rubber for holding a film or paper 3 to be fed between it and the sheet feed shaft S. The sheet feed shaft S is provided with projections A and B in a plurality of separated areas, said projections being formed by a width R in an axial direction while providing a spacing T. The spacing T is a portion of a collar and bush which support the shaft S during the processing of the projections, but the spacing T may not be provided.

Figure 2:
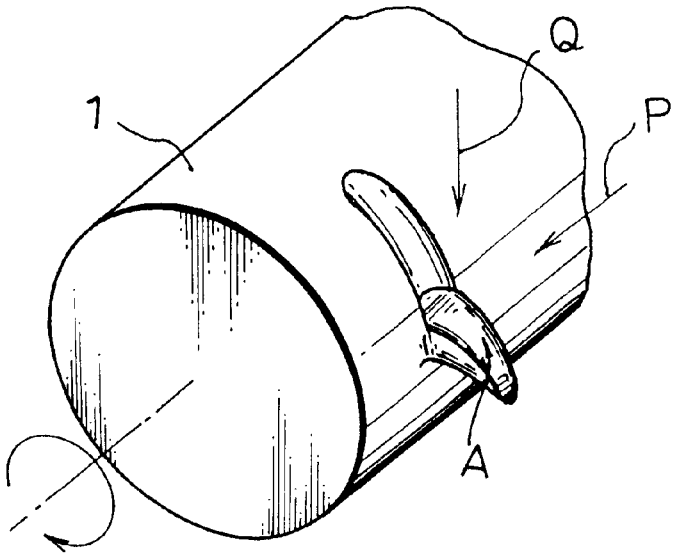
FIG. 2 is a perspective view showing a projection shape in FIG. 1 on an enlarged scale.
Figure 3:
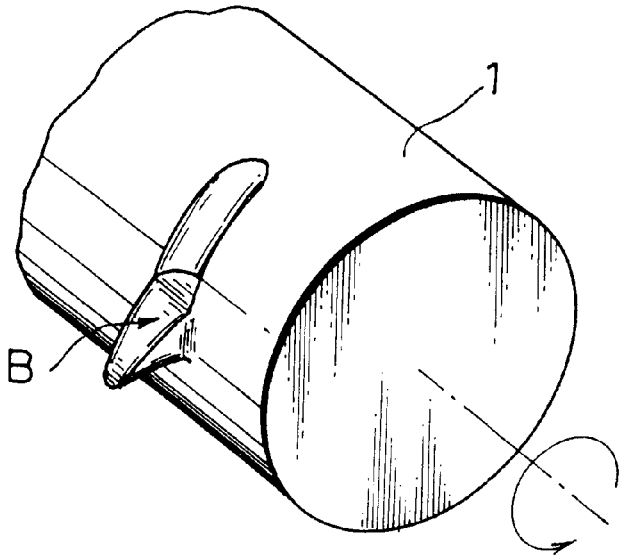
FIG. 3 is a perspective view showing the projection shape in FIG. 1 on an enlarged scale.

As shown in FIGS. 2 and 3 on an enlarged scale, the metallic rod 1 has a plurality of spike-like or spike-shaped projections A and B which are risen at an obtuse angle in a rotational direction of the metallic rod 1, peripherally and axially formed by plastic processing on the circumference whose full length is divided into plural areas. The surface of the metallic rod 1 is subjected to plating processing for 1 to 20$\mu$ of film thickness and quenching process such as tuftride over 1 to 300$\mu$ of depth to enhance the durability.

The spike-shaped projections A and B are suitably provided on the entirety of the metallic rod 1 but may be arranged alternately axially and circumferentially on the peripheral surface of the metallic rod 1.

The spike-shaped projections A and B are formed in the shape of spikes such that they rise at an obtuse angle in a rotational direction of the metallic rod 1 and in a direction opposite to each other by a perforating edge described later.

Accordingly, the projections A and B adjacent to each other in the circumferential direction on the circumferential surface are reverse to each other in a rising direction.

Figure 6:
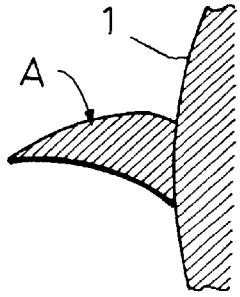
FIG. 6 is a side view of a further projection shape in FIG. 1 as viewed in a direction of arrow P.
Figure 7:
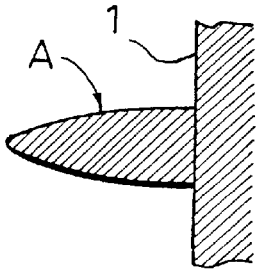
FIG. 7 is a plan view of the further projection shape in FIG. 1 as viewed in a direction of arrow Q.

Further, in the case where the perforating edge is cut relatively shallow into the metallic rod 1 with set width widened, the proximal end of the projection A is so thin that it tends to be bended outward. Therefore, the projection A as viewed from arrow P and Q in FIG. 2 will be a spike-shaped projection which rises long at right angles to or at an obtuse angle to the rotational direction of the metallic rod 1 as shown in FIGS. 6 and 7.

Figure 4:
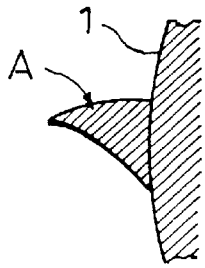
FIG. 4 is a side view of the projection shape in FIG. 1 as viewed in a direction of arrow P.
Figure 5:
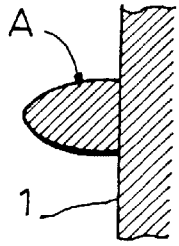
FIG. 5 is a plan view of the projection shape in FIG. 1 as viewed in a direction of arrow Q.

On the other hand, in the case where the perforating member is cut in deeply with the set width narrowed, the proximal end of the projection A is hard to be bended, so that the length projected outward is short to provide a short projection A as shown in FIGS. 4 and 5. In this way, the height of the projection A is selected to 20 to 150 $\mu$m. The same may be said of the projection B.

The sheet feed shaft constructed as described above positively catches both a relatively soft printing sheet as well as a relatively hard film used for an overhead projector even in all directions of rotating movement of the metallic rod 1 along with the sharply pointed projections A and B formed on the outer periphery of the metallic rod 1 to feed them in a set direction smoothly and to a set position properly by the cooperative operation with the feed roller 2.

Further, the erecting height of the projections A and B can be set freely and accurately, which is materially high as compared with the conventional sand blast. The projections A and B are not easily worn, and the positive feeding can be realized for a long period of years.

Accordingly, if this is utilized for a multiple color printing, the multiple color printing with beautiful colors without deviation in color can be realized without occurring deformation in paper or films semipermanently.

Figure 8:
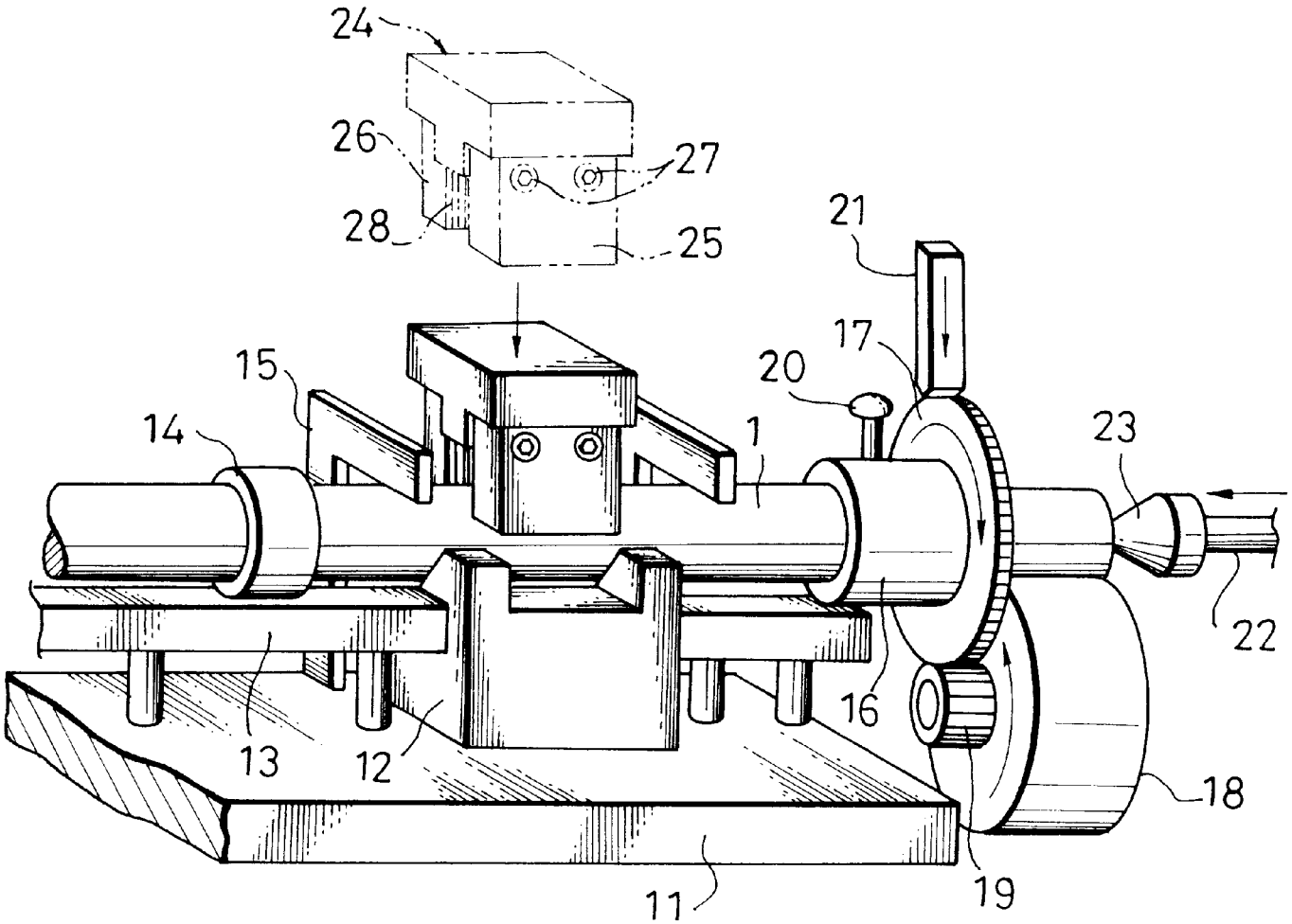
FIG. 8 is a perspective view showing an apparatus for manufacturing a sheet feed shaft according to this invention.

FIG. 8 is a perspective view showing an apparatus for manufacturing a sheet feed shaft according to this invention. In FIG. 8, numeral 11 designates a base, 12 a V block as a support bed installed on the base 11, and 13 a lifter for lifting, from the top of the V block 12, the metallic rod 1 as a processing material supported on the V block 12.

Numeral 14 designates a resinous collar wound around the metallic rod 1 to avoid the direct contact thereof with the lifter 13, and 15 a material removing frame stood upright on the base 11 to prevent the processed metallic rod from being lifted while being bited at the perforating edge of a punch.

Further, numeral 16 designates a holding bush for supporting one end of the metallic rod 1. A split gear 17, which is integrally mounted on the holding bush 16, is meshed with a drive gear 19 of a stepping motor 18. Numeral 20 designates a screw for securing the holding bush 16 to the metallic rod 1.

Numeral 21 designates a detent member which receives a power of an air cylinder or the like so that an extreme end thereof is engaged with the split gear 17. Numeral 22 designates a multipoint locating motor cylinder whose extreme end is placed in contact with the end of the metallic rod 1 through a magnet tip 23.

Numeral 24 designates a punch unit lifted and lowered by a press. A pair of perforating members 25, 26 are secured to the punch unit 24 by means of a fastener (bolt, nut or the like) 27.

Accordingly, if any size of the punch unit 24 is selected, a mounting spacing between the perforating or chisel members 25 and 26 can be suitably set whereby a depth, an angle and a shape of the perforating or knife edge can be suitably set.

Figure 9:
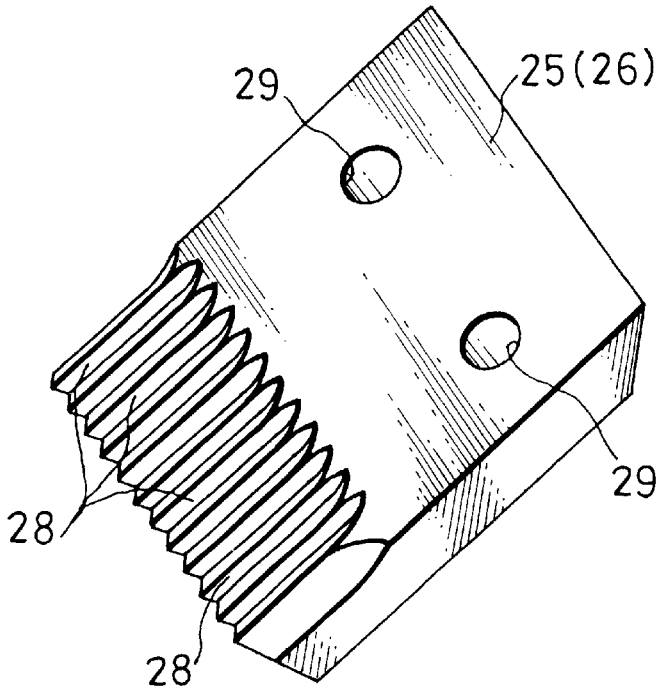
FIG. 9 is a perspective view showing a perforating member.
Figure 10:
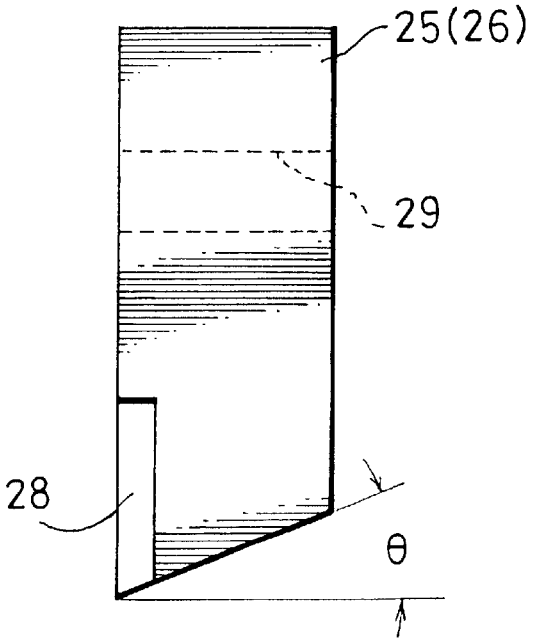
FIG. 10 is a side view showing the perforating member shown in FIG. 9.

The perforating or chisel members 25, 26 are longitudinally formed in one surfaces opposed to each other with a plurality of perforating or knife edges 28, for example, as shown in FIGS. 9 and 10. The perforating edges 28, 28 of the perforating members 25, 26 are disposed while being deviated, for example, in a lateral direction by one pitch of each edge, that is, in an axial direction of the metallic rod 1, by fixing the perforating member 25, 26 deviated. Numeral 29 designates an insert hole of the fastener 27.

In the present embodiment, a rake angle θ (if 2° to 10° from the edge is set so that the projections A and B have a sharp end shape. With this, the processing pressure can be relieved, and the sufficient spike-like projections A and B can be obtained with less cutting.

Figure 11:
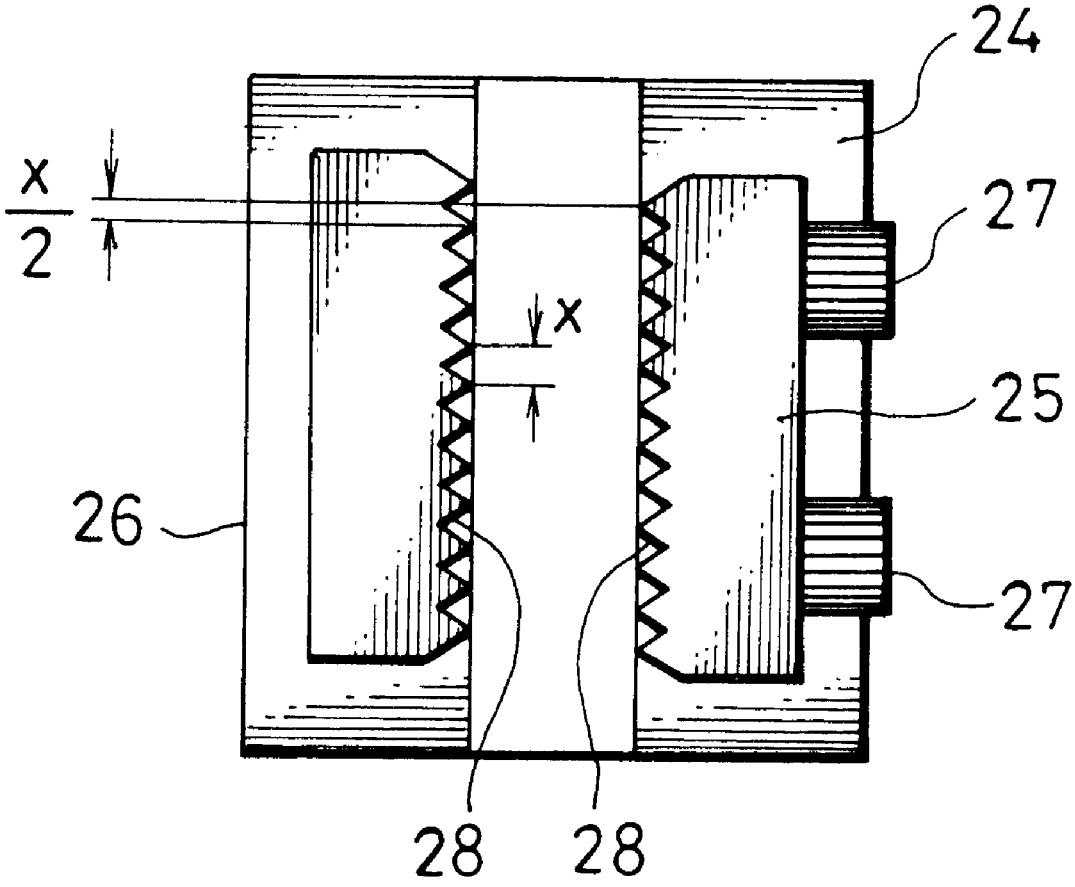
FIG. 11 is a lower view showing an example of arrangement of the perforating member shown in FIG. 8.

Further, the perforating members 25, 26 are opposed to each other as shown in FIG. 11 while maintaining a spacing calculated in advance corresponding to the dimension of an outside diameter of the metallic rod 1, and the perforating edges 28 opposed to each other are arranged with a position deviated by X/2, that is, half of one angular pitch X, for example.

In manufacturing a sheet feed shaft using the apparatus for manufacturing a sheet feed shaft, first, the metallic rod 1 is arranged on the V block 12 so that when the punch unit 24 is moved upward, the resinous collar 14 and the holding bush 16 are supported on the lifter 13.

At this time, the lifter 13 is raised by 2 to 3 mm by means of a spring (not shown) to thereby avoid interference of a processed part with the V block 12 by the motor cylinder 22 when moving in an axial direction.

Next, the extreme end of the detent member 21 is released from engagement through the split gear 17. The position for processing the metallic rod 1 is located, for eaxmple, by rotating the stepping motor 18. When the position is determined, the holding bush 16 is locked to the metallic rod 1 by the screw 20, and the extreme end of the detent member 21 is brought into engagement with the gear 17.

Next, the punch unit 24 at the top dead center is moved down in a direction of arrow in FIG. 8, and the perforating edges 28 of the perforating members 25, 26 are cut into the position opposite to the peripheral surface of the metallic rod 1.

By this cutting, the spike-like projections A and B opposite to each other are erected to the equal height at an angle of 90° or an angle in excess thereof, as shown in FIGS. 2 and 3.

After the projections A and B have been formed row by row, the biting of the perforating edge 28 into the metallic rod 1 is released with the help of the material removing frame 15, and the punch unit 24 is moved up to the top dead center.

Thereafter, the detent member 21 is again released from engagement through the split gear 17. The stepping motor 18 is rotated through a predetermined angle, and the split gear 17 engaged with the drive gear 19 is likewise rotated through a predetermined angle to change a rotation support position of the metallic rod 1.

After the rotational position of the metallic rod 1 has been determined, the rotational position of the split gear 17 is again locked by the detent member 21. The perforating members 25, 26 are moved down by the operation of the punch unit 24, and the projections A and B are formed on the row adjacent to the circumferential direction of the projections A and B of each row formed previously.

The operation described above is sequentially repeated, so that the metallic rod 1 is rotated once to complete the processing. At this time, the projections A and B for the width R in FIG. 1 may be formed at a time by the size of the punch unit 24, or may be processed by a few steps with the punch unit 24 deviated in an axial direction. In this case, the position, the direction, the angle and the height of the projections A and B within the width R can be combined in various patterns by processing the punch unit 24.

Figure 12:
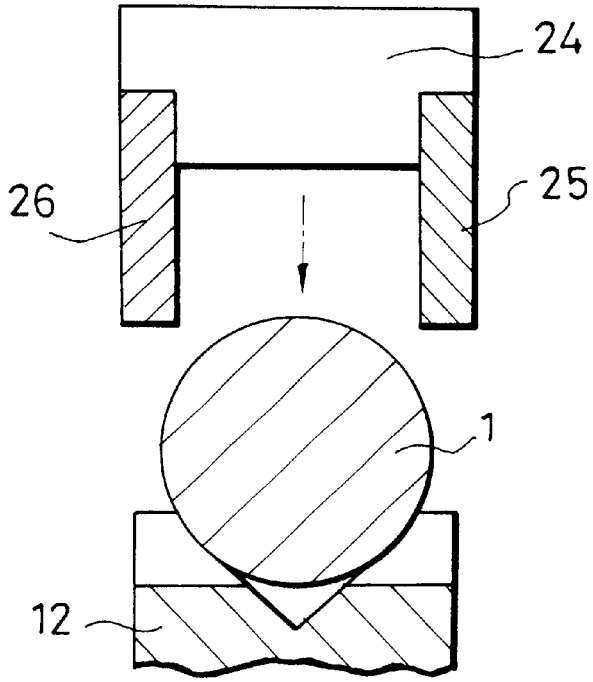
FIG. 12 shows a first step of forming a projection by a perforating edge in FIG. 3.
Figure 13:
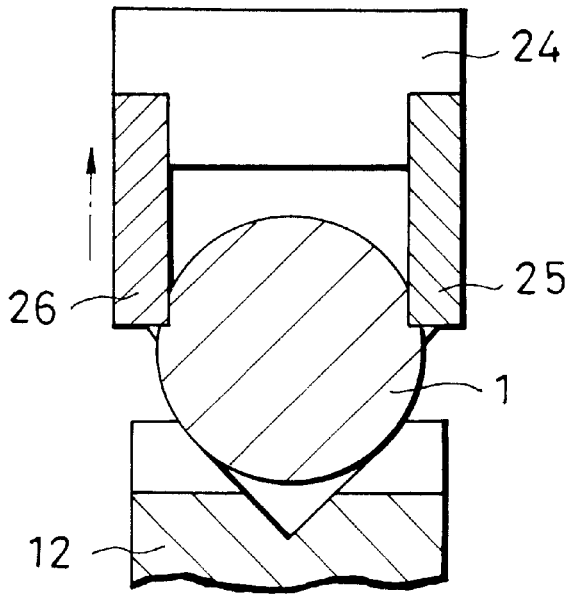
FIG. 13 shows a second step of forming a projection by the perforating edge in FIG. 3.
Figure 14:
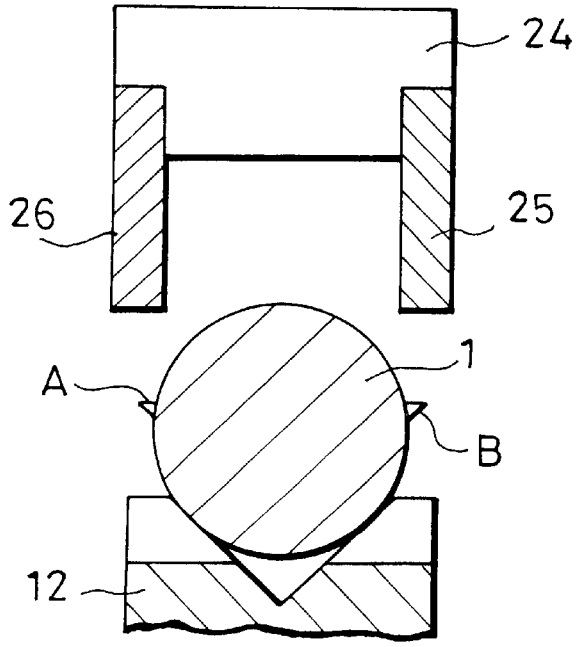
FIG. 14 shows a third step of forming a projection by the perforating edge in FIG. 3.

FIGS. 12 to 21 show the step of forming the projections A and B as described above by the perforating edges 28 in two perforating members 25 and 26, FIG. 12 showing the state before forming the projections A and B. The projections A and B are cut by the processing of the punch unit 24 as shown in FIG. 13 to form the projections A and B of each row as shown in FIG. 14.

Figure 15:
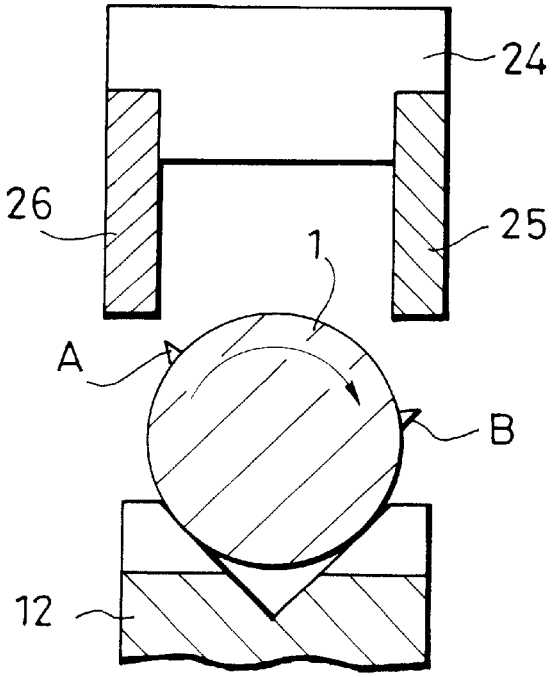
FIG. 15 shows a fourth step of forming a projection by the perforating edge in FIG. 3.

At this time, the punch unit 24 is moved up, and the split gear 17 is rotated by a predetermined amount by the stepping motor 18 to rotate the metallic rod 1 by the same amount in the same direction as shown in FIG. 15.

Figure 16:
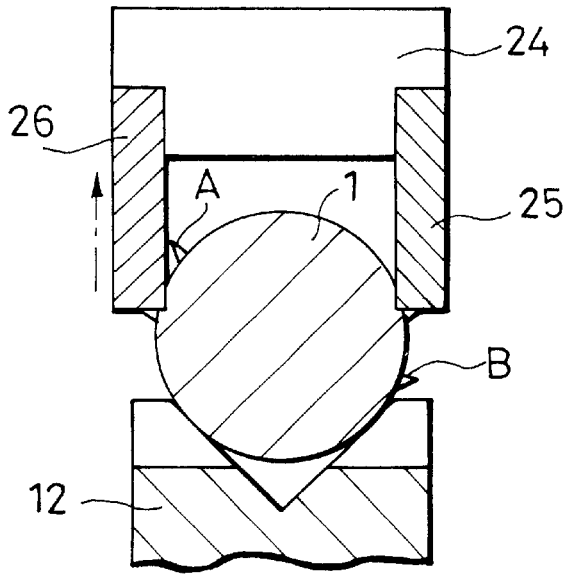
FIG. 16 shows a fifth step of forming a projection by the perforating edge in FIG. 3.
Figure 17:
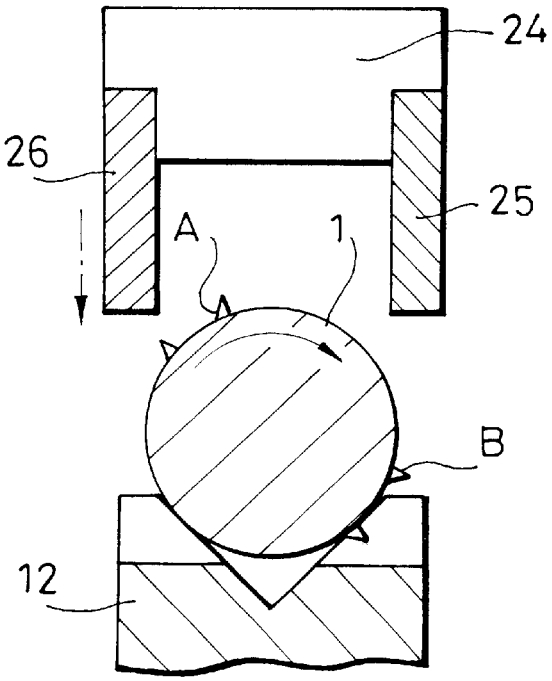
FIG. 17 shows a sixth step of forming a projection by the perforating edge in FIG. 3.

The split gear 17 is stopped in rotation, that is, locked, and the punch unit 24 is moved down as shown in FIG. 12, and other projections A and B are formed on the metallic rod 1 so as to be adjacent to two rows of the projections A and B, as shown in FIGS. 16 and 17.

Figure 18:
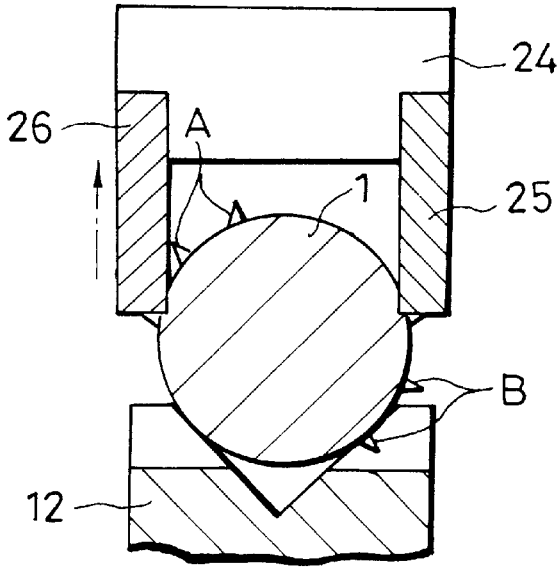
FIG. 18 shows a seventh step of forming a projection by the perforating edge in FIG. 3.
Figure 19:
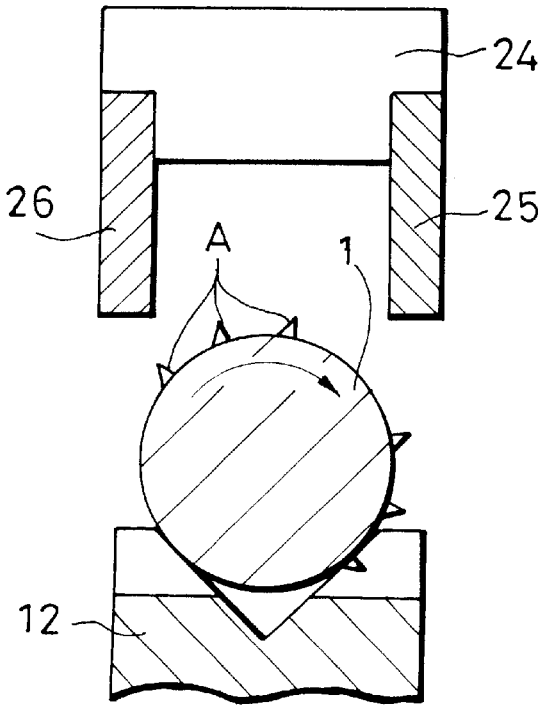
FIG. 19 shows an eighth step of forming a projection by the perforating edge in FIG. 3.

The above operation is sequentially repeated, so that the metallic rod 1 is rotated once from the state shown in FIGS. 18 and 19 to complete the first processing.

Figure 20:
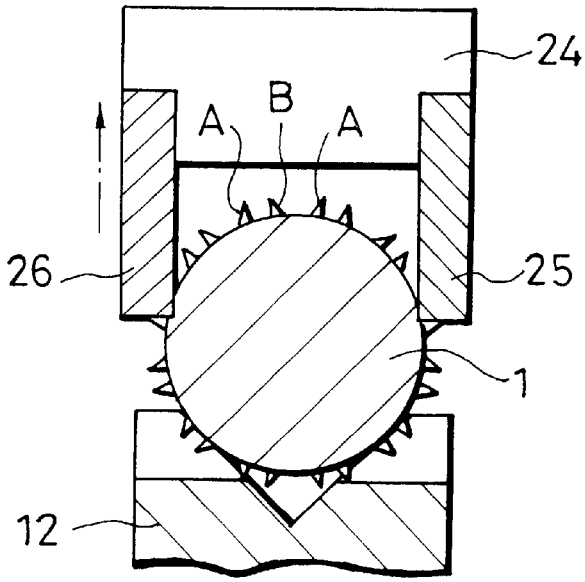
FIG. 20 shows a ninth step of forming a projection by the perforating edge in FIG. 3.
Figure 21:
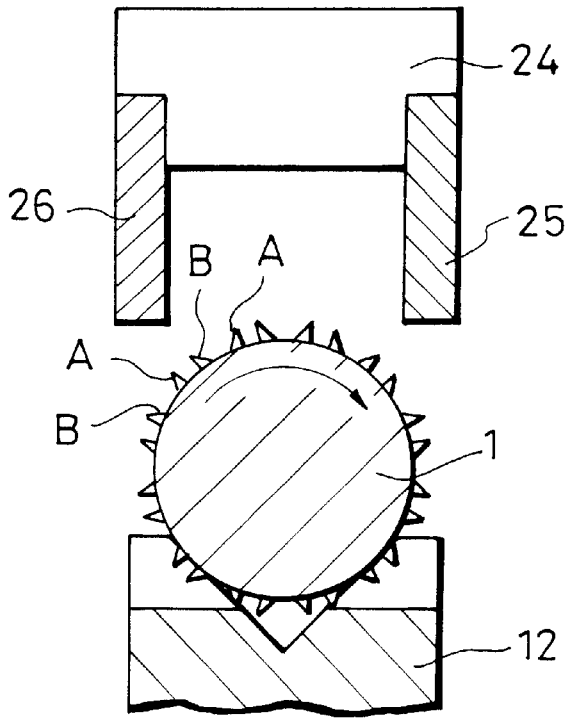
FIG. 21 shows a final step of forming a projection by the perforating edge in FIG. 3.

Then, when the above operation is again continued, the perforating edge 28 of the perforating members 25, 26 is moved between the projections A and B formed by the first processing, and the projections A and B different in rising direction from each other as shown in FIG. 20 are formed so as to be adjacent to each other in the circumferential direction as shown in FIG. 21 in each spacing.

In the final step shown in FIG. 21, the step is returned to the processing start point after rotation by one tooth, and the metallic rod 1 is fed to the next processing position by the multipoint locating motor cylinder 22.

Figure 22:
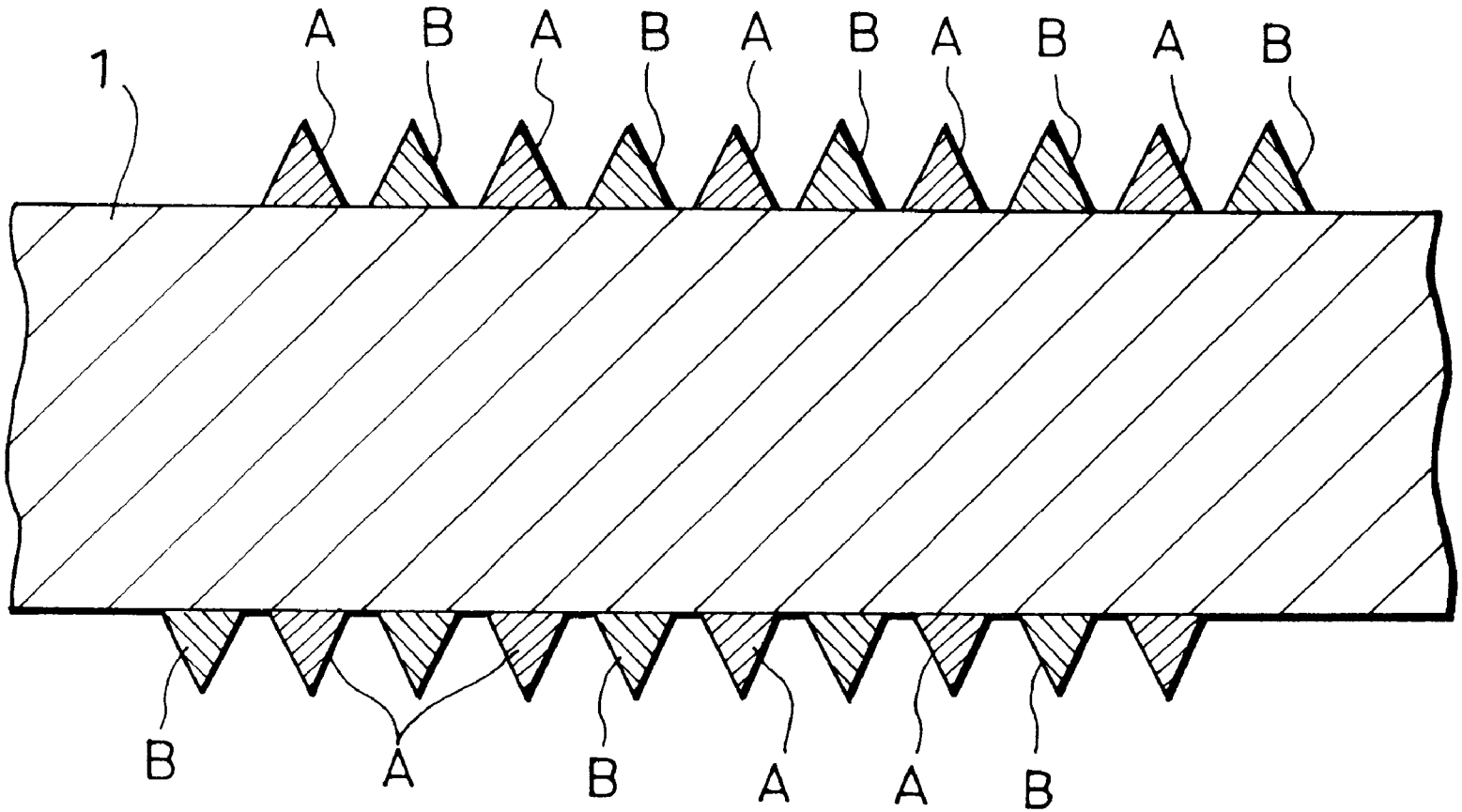
FIG. 22 is a front sectional view showing an example of arrangement of the projections formed by the steps shown in FIGS. 12 to 21.
Figure 23:
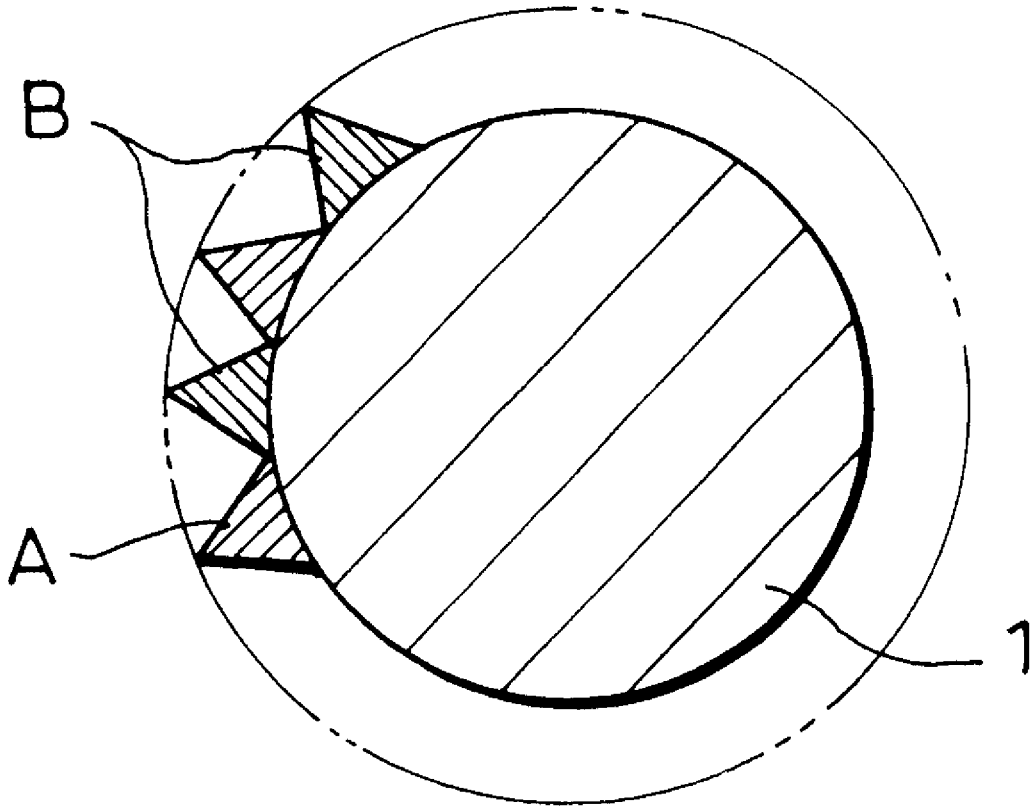
FIG. 23 is a side sectional view showing an example of arrangement of the projections formed by the steps shown in FIGS. 12 to 22.

FIGS. 22 and 23 show an example of arrangement of the projections formed as described above, in which one projection A different in rising direction is forward one and the other projection B is reverse one.

FIGS. 24 to 28 show in section the edge shape of the perforating edges of the perforating members 25 and 26 used in the apparatus for manufacturing the sheet feed shaft. FIGS. 28 to 31 shows in axial section the shape of the projections subjected to plastic processing on the metallic rod 1 according to the shape of the edges.

Figure 24:
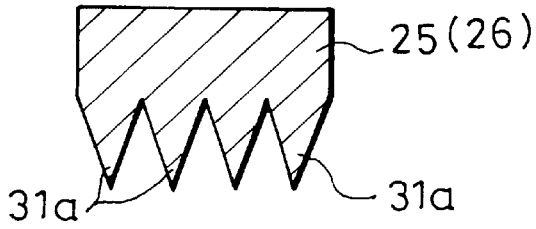
FIG. 24 is a sectional view showing a perforating edge of a perforating member according to this invention.
Figure 28:
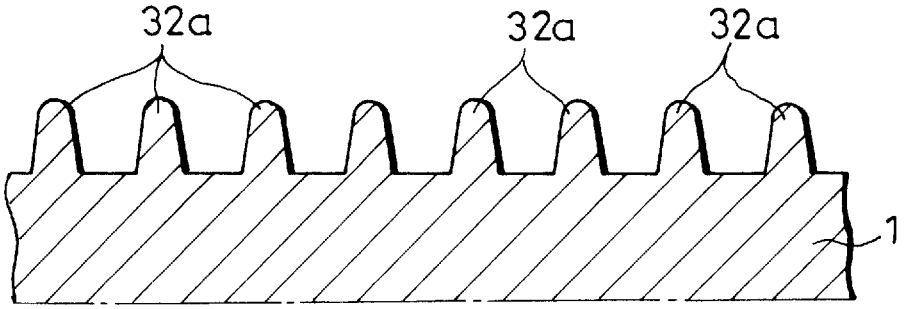
FIG. 28 is a sectional view showing a projection shape corresponding to FIG. 24.
Figure 29:
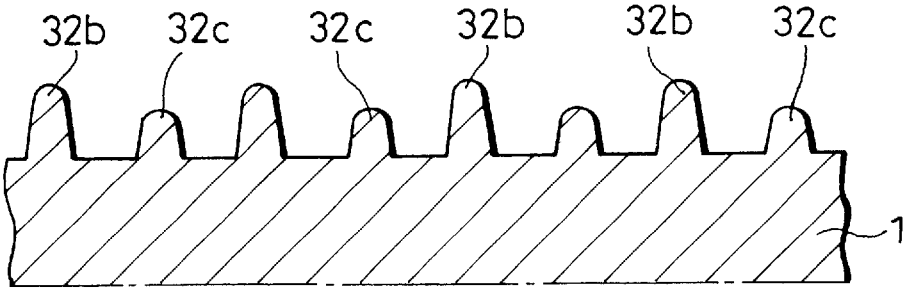
FIG. 29 is a sectional view showing a projection shape corresponding to FIG. 25.

That is, when all the perforating edges 31*a* in FIG. 24 are triangular whose shape and size are equal, projections 32*a* which have the same shape and whose end is circular as shown in FIG. 28 are subjected to plastic processing. This edge shape is suitable for feeding a sheet such as a relatively hard film. In triangular perforating edges 31*b*, 31*c* alternately different in projecting length as shown in FIG. 25, projections 32*b*, 32*c* whose end is circular and alternately different in projecting length are formed as shown in FIG. 29.

Figure 26:
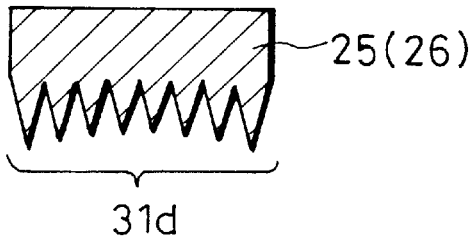
FIG. 26 is a sectional view showing a perforating edge of a perforating member according to this invention.
Figure 30:
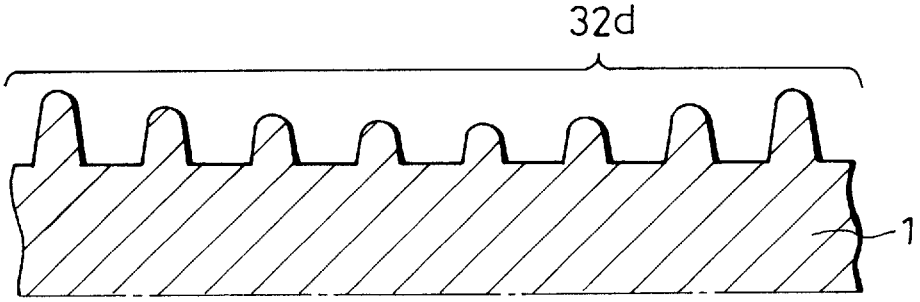
FIG. 30 is a sectional view showing a projection shape corresponding to FIG. 26.

In a row of triangular perforating edges 31*d* whose projecting length changes in concave configuration in which the perforating edges arranged in parallel are smoothly curved as a whole as shown in FIG. 26, a row of projections 32*d* whose end is circular and lengths are different and projecting length changes in concave circular configuration as a whole is formed as shown in FIG. 30.

Figure 27:
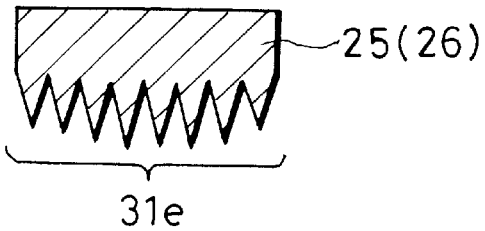
FIG. 27 is a sectional view showing a perforating edge of a perforating member according to this invention.
Figure 31:
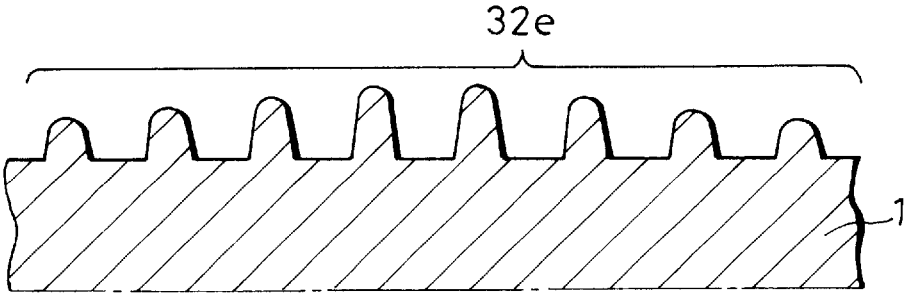
FIG. 31 is a sectional view showing a projection shape corresponding to FIG. 27.

In a row of triangular perforating edges 31*c* whose projecting length changes in convex configuration in which the perforating edges arranged in parallel are smoothly curved as a whole as shown in FIG. 27, a row of projections 32*c* whose end is circular and projecting length changes in convex circular configuration as a whole is formed, as shown in FIG. 31.

Figure 25:
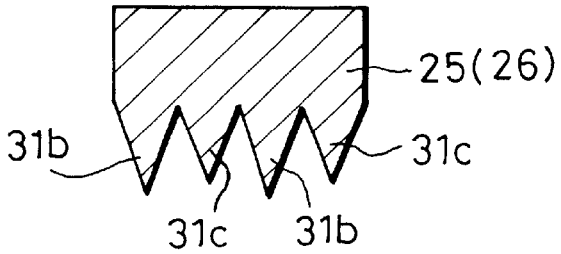
FIG. 25 is a sectional view showing a perforating edge of a perforating member according to this invention.

In perforating edges 31*b*, 31*c* and perforating edges 31*d*, 31*c* shown in FIGS. 25 and 26, respectively, these are effective for feeding in the case where sheets to be fed are in a predetermined concavo-convex pattern or a circular pattern and different in thickness, and can be also used for a frictional rotating operation of a drum-like member having such patterns as described.

Figure 32:
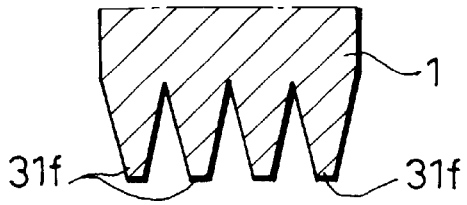
FIG. 32 is a sectional view showing a further perforating edge of a perforating member according to this invention.
Figure 33:
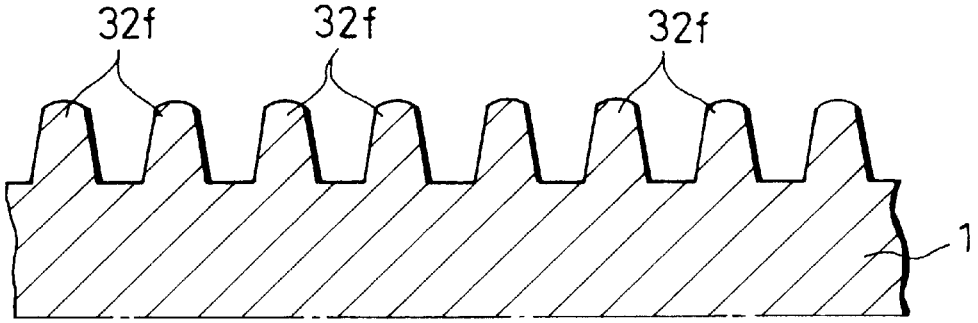
FIG. 33 is a sectional view showing a projection shape corresponding to FIG. 32.

FIG. 32 shows a plurality of perforating edges 31*f* which are the same in shape and size and are trapezoidal. In such perforating edges 31*f*, projections 32*f* which are in the form of a circular edge whose end is gentle and have the same length are subjected to plastic processing as shown in FIG. 33.

The projections 32*f* are suitable for sheets to be fed which are made of soft material to prevent the edge from being strongly bited into the sheet to scratch it.

In trapezoidal perforating edges 31*f* as shown in FIG. 32, the projecting lengths may be alternately differentiated or changed into a wholly curved concave or convex configuration as in the embodiment previously described, thereby being applicable to the sheet feed for special uses.

Figure 34:
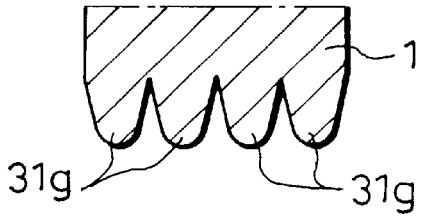
FIG. 34 is a sectional view showing another perforating edge of a perforating member according to this invention.
Figure 35:
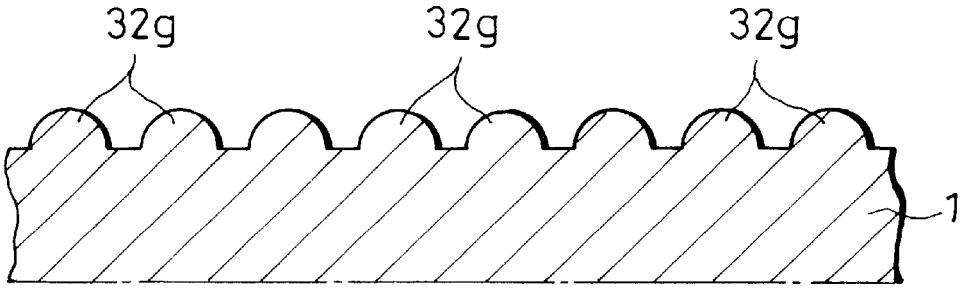
FIG. 35 is a sectional view showing a projection shape corresponding to FIG. 34.

FIG. 34 shows a plurality of perforating edges 31*g* whose shape and size are the same and which are substantially oval adjacent to each other. In the perforating edges 31*g*, projections 32*g* whose end is substantially semicircular as shown in FIG. 35 are subjected to plastic processing and the projections 32*g* come in point contact with a sheet, thus being effective for feeding a hard film.

Also in the perforating edges 31*g* as shown in FIG. 34, the projecting lengths may be alternately differentiated or changed into a wholly curved concave or convex configuration as in the embodiment previously described, thereby being applicable to the sheet feed for special uses.

Figure 36:
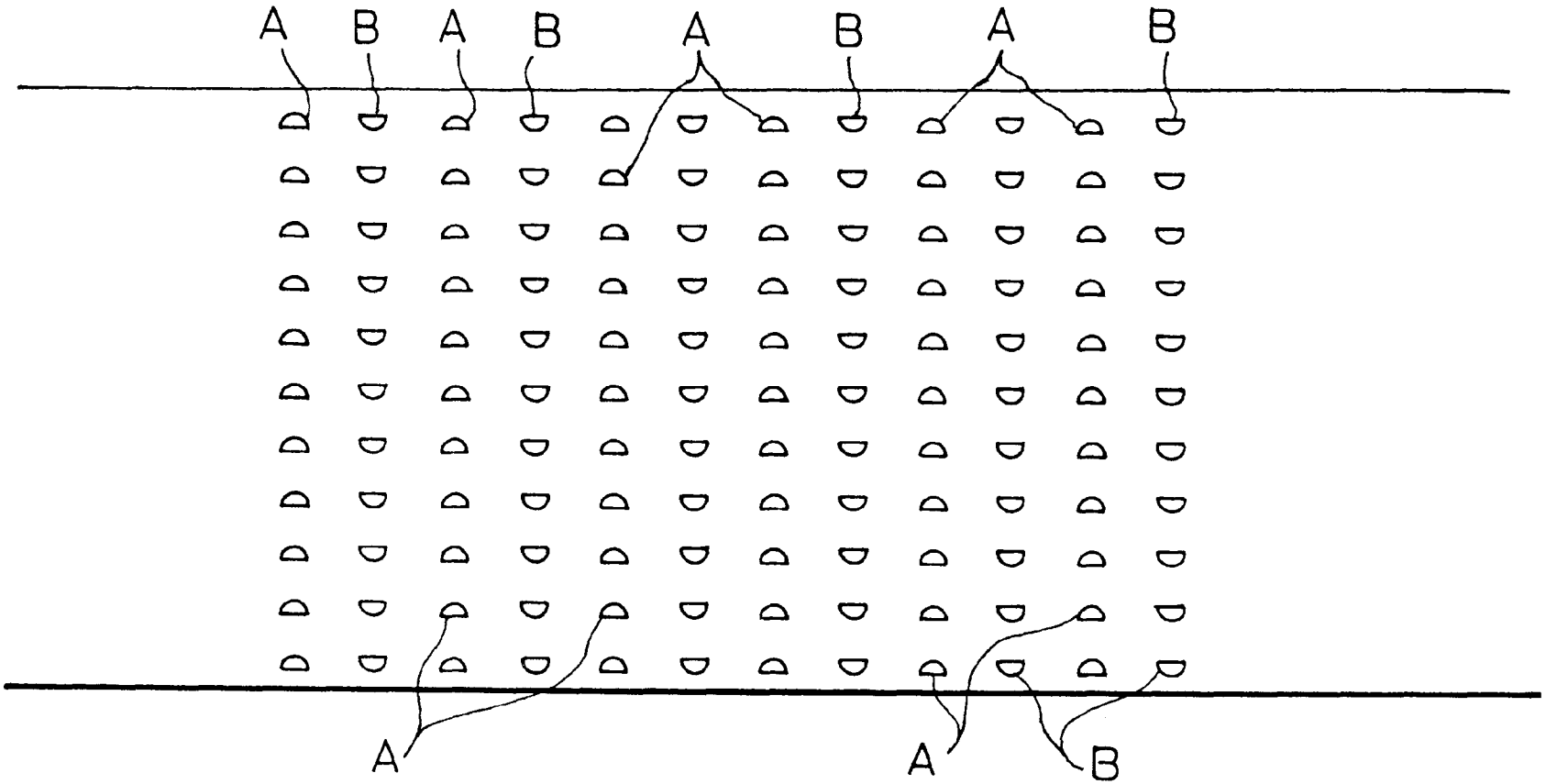
FIG. 36 is a partly enlarged development view showing an arranging pattern of projections provided on a metallic rod according to this invention.

FIG. 36 is a partly enlarged development view showing a basic arranging pattern of the projections A and B formed on the metallic rod 1 by the use of the perforating members 25, 26 in the punch unit 24 as described above. In this case, the projections A and B are formed with the perforating edges 28 of the perforating members 25 and 26 opposed to each other deviated mutually half of one angular pitch, and they are all the same in shape and size. Here, the projections A and B formed by the perforating edges 28 of the perforating members 25 and 26 are orderly provided on one and the same axis over plural rows, and the projections A and B of each row are orderly arranged in the circumferential direction. The directions of the rows of projections A and B adjacent to each other are opposed to each other.

By using the metallic rod 1 having the projections A and B as described above, since all the projections A and B arranged oppositely on one and the same axis are bited into a relatively soft film or paper 3, they can be fed in both normal and reverse directions while being held between the projections and the feed roller 2, resulting in providing a powerful carrying force.

Figure 37:
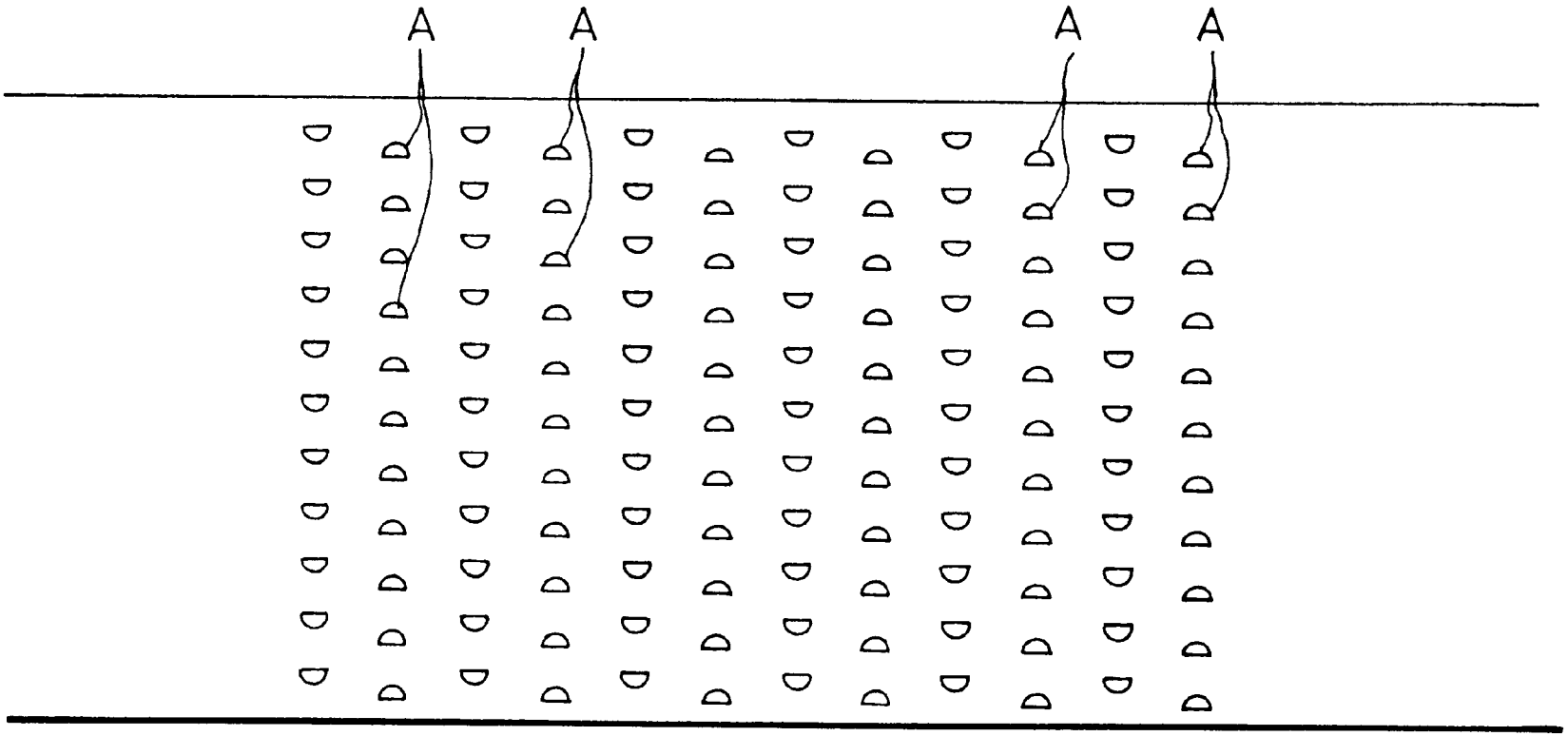
FIG. 37 is a partly enlarged development view showing a further arranging pattern of projections provided on a metallic rod according to this invention.

FIG. 37 shows the state in which each row of projections A and B as shown in FIG. 36 are provided in the circumferential direction so as to be deviated by half pitch, for example. Also in this case, it is effective for feeding the relatively soft paper 3 in the reciprocating direction, as described above, and feed scratches on the horizontal line in the surface of the paper 3 can be reduced for a portion reduced in number of the projections on one and the same axis as compared with the pattern of FIG. 11.

Figure 38:
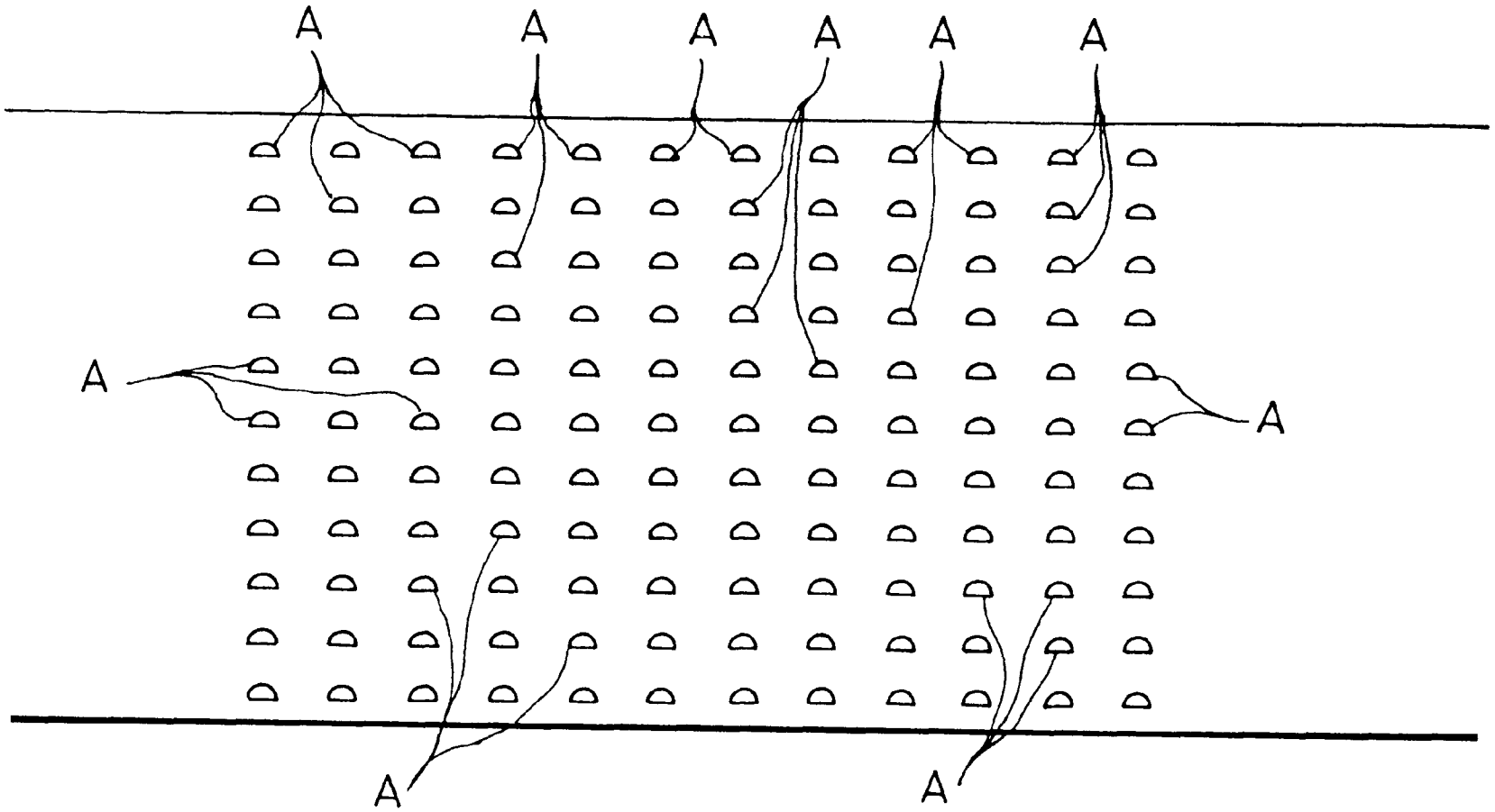
FIG. 38 is a partly enlarged development view showing another arranging pattern of projections provided on a metallic rod according to this invention.

Further, in FIG. 38, only the projections A of the same shape and size are provided orderly on the same axis and on the same circumferential edge over the entire peripheral surface of the metallic rod 1. In this case, all the projections A are erected in the form of spikes by one perforating edge 28 of the perforating members 25, 26. Therefore, the rows of projections A adjacent to each other are formed to be directed in the same direction.

In the metallic rod 1 having only the projections A, since the all the projections are directed in the same direction, it is effective for the case where the paper 3 held between the projections and the feed roller 2 is fed powerfully only in one direction to provide a monocolor printing. In this case, it is not necessary to consider a mutual deviation (pitch) between the perforating edges 28 of the opposed perforating members 25 and 26, and the operation of forming the projections A can be carried out simply and quickly. The same may be said of the case where the projections B are used in place of the projections A.

Figure 39:
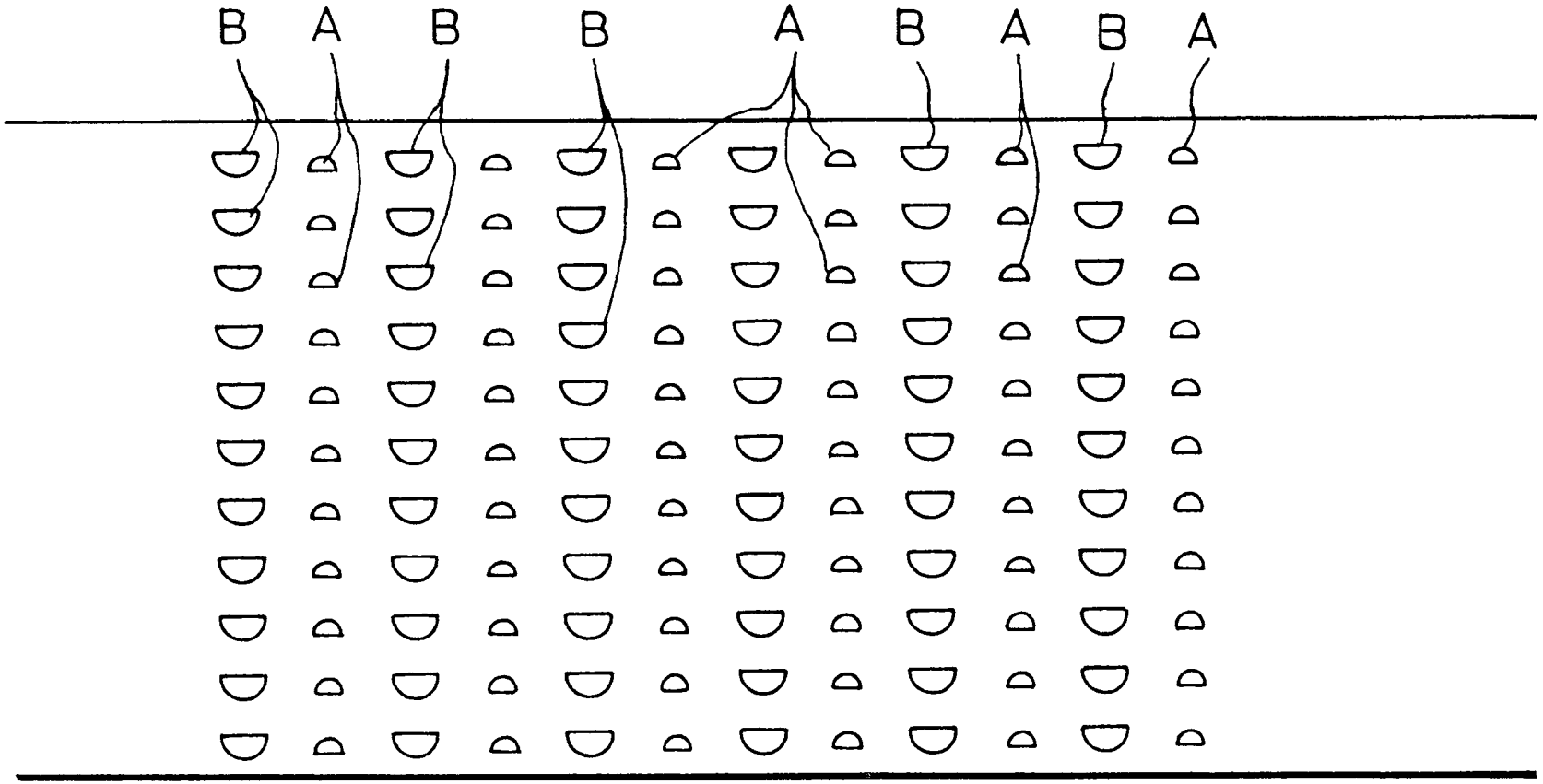
FIG. 39 is a partly enlarged development view showing still another arranging pattern of projections provided on a metallic rod according to this invention.

FIG. 39 shows another embodiment of this invention. In this embodiment, the projections A which are low in height shown in FIGS. 4 and 5 are used, and the projections B which are high in height shown in FIGS. 6 and 7 are used. In each row of projections A and B, positions thereof are arranged in order in the axial direction and in the circumferential direction, and there is a difference in height between the projections A and B. In this case, there is a difference in carrying force between the normal direction and the reverse direction. However, the high projections B first stick in the paper 3 during the carriage, so that the number of projections per unit is less suspectedly. The projections are bited deeply and powerfully even under the same pressure whereby a powerful carrying force is created even in a material which is hard to stick such as a film for a projector. When high projections and low projections are dispersed, the high projections first stick in the film, and finally the low projections stick in or the surface of the film is supported to stabilize the film, thus preventing the occurrence of creases or rents of the film. Further, since the number of both high and low projections remains unchanged, the merit of that same basic pattern as that of FIG. 36 is provided. It is noted that the projections A or B having a difference in height may be directed in the same direction as in the pattern shown in FIG. 38.

Figure 40:
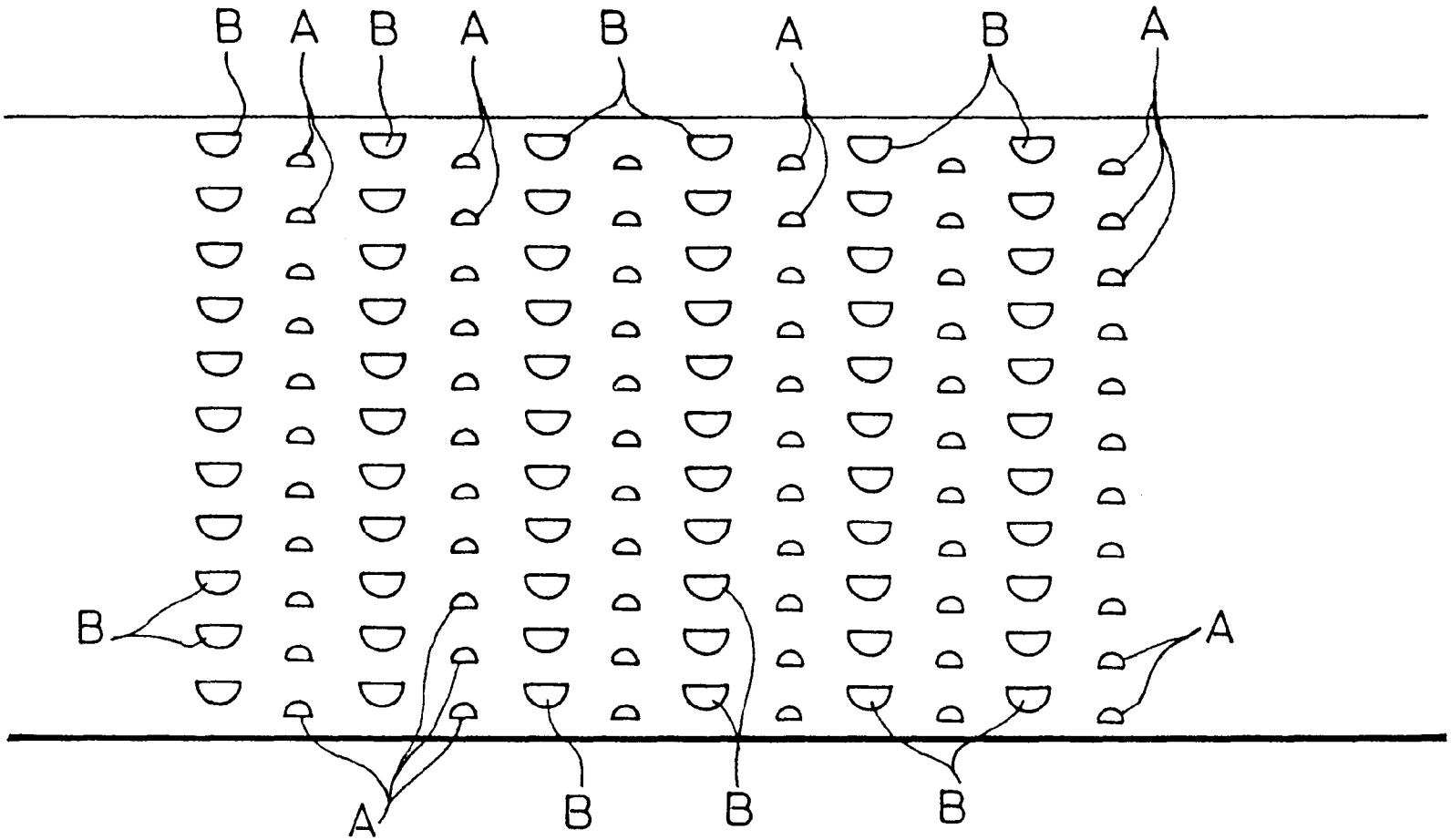
FIG. 40 is a partly enlarged development view showing further another arranging pattern of projections provided on a metallic rod according to this invention.

On the other hand, in FIG. 40, the rows of projections A and B shown in FIG. 39 are deviated in position by half pitch, for example. Also in this case, the feeding of paper 3 can be carried out positively and smoothly in a similar manner to the above. Further, the configuration shown in FIGS. 39 and 40 is effective for uses in which in one direction of reciprocation, the paper 3 is fed by a powerful force, while in the other direction thereof, the paper 3 is fed by a weak force.

Figure 41:
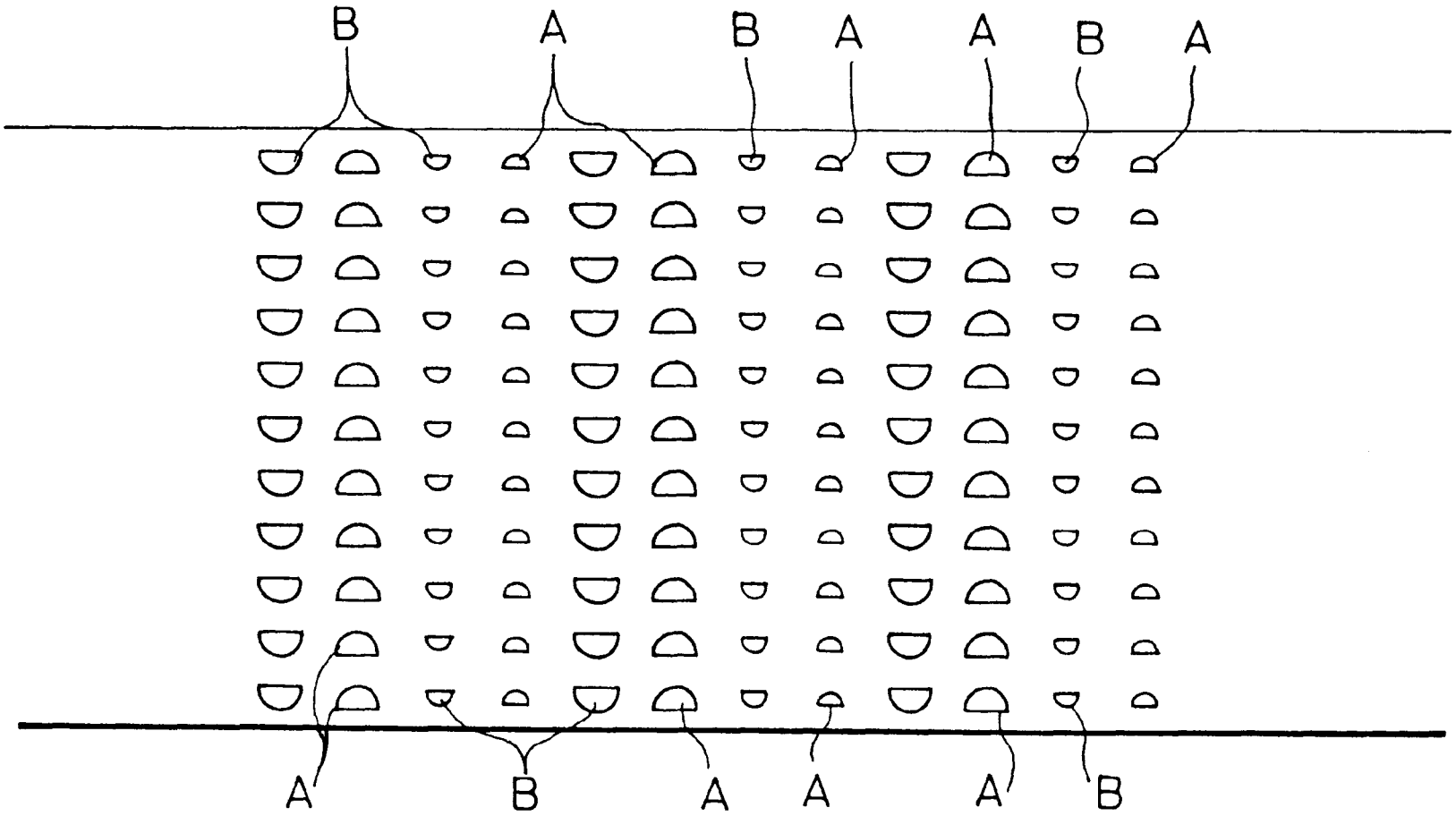
FIG. 41 is a partly enlarged development view showing further still another arranging pattern of projections provided on a metallic rod according to this invention.

FIG. 41 shows another embodiment of this invention. In this embodiment, two kinds of high and low projections A and B are arranged in plural rows in the same circumferential direction and in the same axial direction of the metallic rod 1, and the high projections A and B and the low projections A and B adjacent to each other are taken as one group, and a plurality of groups are alternately arranged.

In this case, effects of both the basic pattern of FIG. 36 and the pattern having a difference in height of FIG. 39 are obtained.

Figure 42:
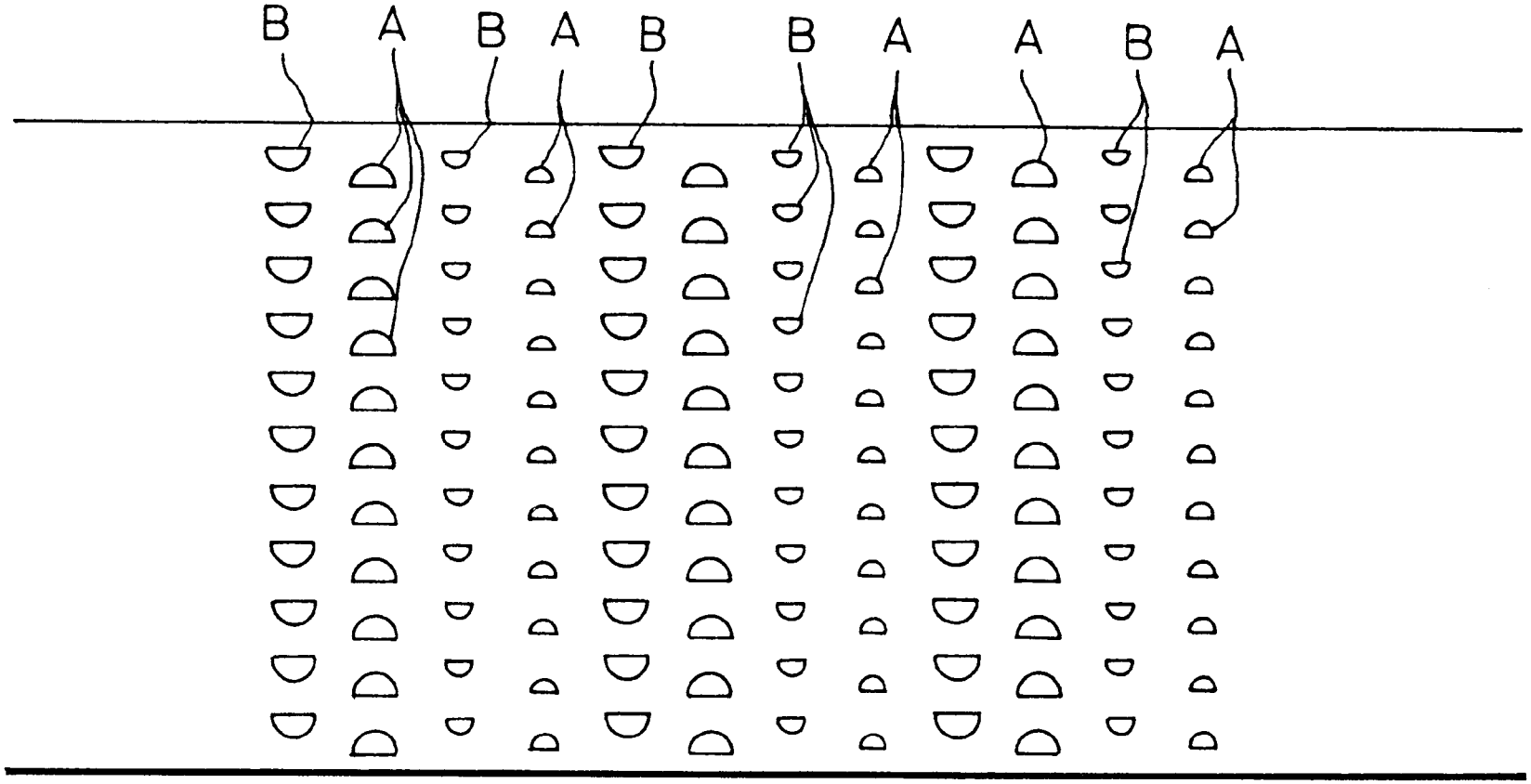
FIG. 42 is a partly enlarged development view showing further still another arranging pattern of projections provided on a metallic rod according to this invention.

In FIG. 42, the projections A and B in each group shown in FIG. 41 are arranged to be deviated in position in the circumferential direction. In this case, also, the operation and effect similar to that shown in FIGS. 37 and FIG. 41, are provided.

In this invention, the projections A and B are provided separately on a plurality of areas, as shown in FIG. 1, at the spacing T in the axial direction of the metallic rod 1. More specifically, the axial width R in each area is 5 to 100 mm, and the spacing T is 5 to 300 mm. The spacing T may not be provided.

Figure 43A:
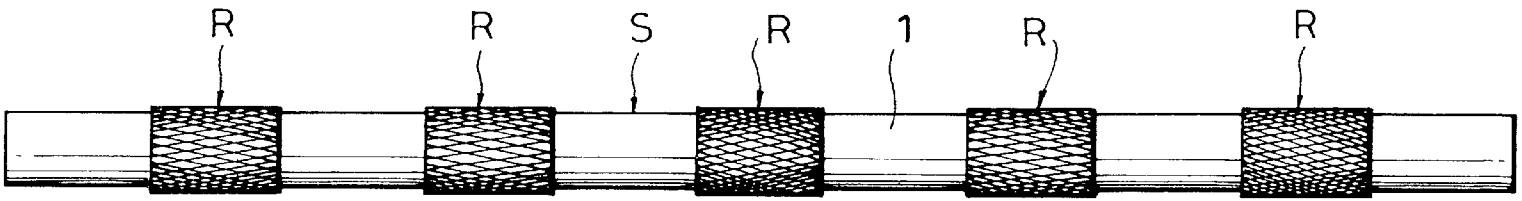
FIG. 43*a* is a front view of the sheet feed shaft according to one embodiment of the present invention.
Figure 43B:
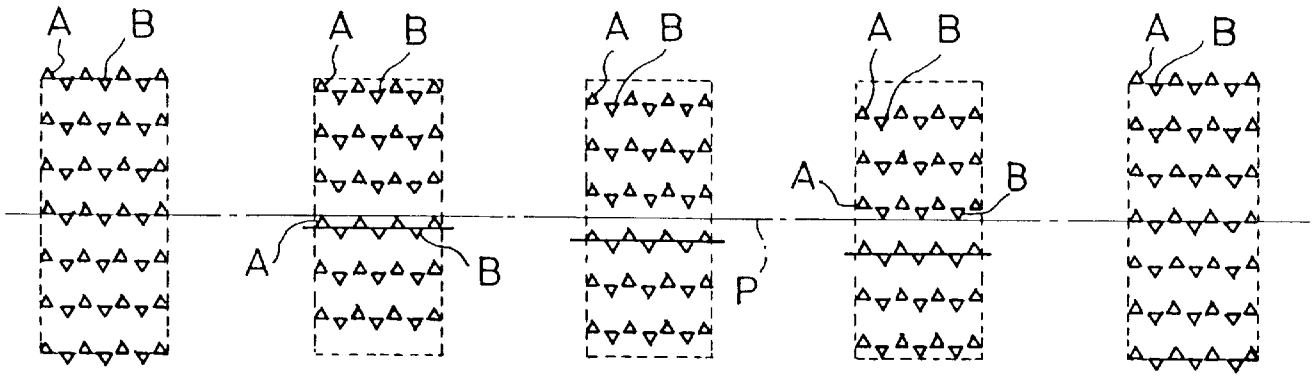
FIG. 43*b* is a partly enlarged development view of the projections.

FIG. 43 shows a feed shaft S according to another embodiment.

As shown in FIG. 43(*a*), the sheet feed shaft S comprises a metallic rod 1, and projections A and B formed on the outer periphery of five parts R1, R2, R3, R4 and R5 on the outer periphery of the rod 1. The projections A and B in a basic pattern shown in FIG. 36 are formed on the outer periphery of the five parts R1, R2, R3, R4 and R5 as shown in a partly enlarged development view of FIG. 43(*b*). In this case, the projections A and B at the part R2 are formed with respect to the projections A and B at the part R1 while being deviated at a suitable angle, for example, at an index angle of ¼ in the circumferential direction. The projections A and B at the part R3 and at the part R4 are likewise deviated in position in the circumferential direction by the same angle, and the projections A and B at the part R5 are formed on the same axis as the projections A and B at the first part R1. Therefore, even if the rod 1 should be rotated by the half pitch, the projections A and B at any of parts would be bited in the film or paper 3 without fail. For example, the projections A and B at the parts R2 and R4 are positioned on an imaginary line P of FIG. 43(*b*). For example, in normal rotation, the projections A at the part R2 are bited into the paper 3 to feed it, and in reverse rotation, the paper 3 is can be fed by the projections B at the part 4.

That is, the sheet feed shaft S according to the embodiment shown in FIG. 43 is processed with a circumferential process start position deviated little by little when the projections A and B are formed, so that the projections A and B are present uniformly on the surface of the rod 1. At the initial stage of feeding paper or film, that is, at the time of so-called initial sucking, the projections A or B at any of the parts R1, R2, R3, R4 and R5 come in contact with the end of paper or film to enable the stabilized sucking of paper.

Figure 44:
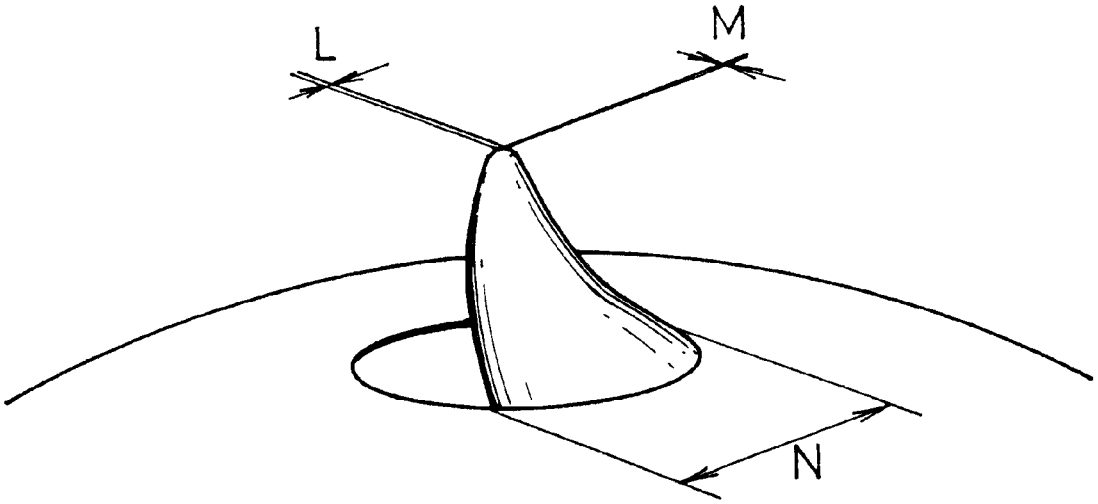
FIG. 44 is a dimension view of parts of the projection according to the present invention.

FIG. 44 shows one example of detailed dimensions of the projections A and B. Here, the end width L is 10 to 500 $\mu$m, the end thickness M is 1 to 300 $\mu$m, the proximal width N is 0.2 to 5.0 mm, and the height is 20 to 150 $\mu$m.

The proximal width N is the value employed in the practical range used for machines on scale of a printer, a scanner or the like.

The circumferential spacing between the projections is determined according to the number of divisions by a combination of the diameter and the height of the projections. For example, when the diameter is 10 mm, the height of the projections is 40 to 90 $\mu$m, and the distance (peripheral length) of 50 to 100 equally divided is approximately 0.6 to 0.3 mm.

The width R of each group of projections (processing portion) on the metallic rod 1 as a shaft is 5 to 100 mm in the practical range used for machines on scale of a printer or a scanner as shown in FIG. 1 depending on the width of the perforating edges 28. The group of projections secures 5 to 300 mm or more of the spacing T to obtain the number of projections proportional to the axial length and the width R of the group of projections which is the processing width.

The present invention has the following effects:

(1) A plurality of spike-like projections risen at an obtuse angel or at an acute angle or at right angels in the rotational direction of a metallic rod are separately provided in a plurality of areas in the axial direction of the metallic rod. Therefore, sheets such as paper or hard films can be accurately fed in an intended direction while maintaining an accurate position merely by plastic processing applied to the peripheral surface of the metallic rod.

(2) Since the projections in each area are deviated in suitable angle, in the initial state of feeding paper or film, that is, in the so-called sucking, any of projections come into contact with the end face of paper without fail. Therefore, the stable sucking is enabled.

(3) Plural rows of the projections are provided in the circumferential direction of the peripheral surface of the metallic rod. Therefore, sheets such as paper or hard films can be accurately fed in an intended direction while maintaining an accurate position merely by plastic processing applied to the peripheral surface of the metallic rod.

(4) Plural rows of the projections are provided in the circumferential direction of the peripheral surface of the metallic rod, and the projections adjacent to each other are made as a group, a plurality of groups being provided alternately. Therefore, the form of the projections in each group is made to be the same, the processing number of projections by the perforating members is increased and the form is varied to thereby realize the optimum feeding force and returning force according to properties of paper, thus obtaining more excellent feeding effect.

(5) The rows or groups of projections adjacent to each other are formed in the same direction. Therefore, the number of contact points with the paper surface is increased, so that the feeding in one direction can be positively carried out.

(6) The rows or groups of projections adjacent to each other are formed in the direction opposed to each other. Therefore, the feeding and returning in the reciprocating direction can be positively and smoothly carried out.

(7) The rows or groups of projections adjacent to each other have a difference in height therebetween. Therefore, the high projections stick in a film or the like during the carriage, and even a film which is hard to be stuck under the same pressure creates a powerful carrying force.

(8) The rows or groups of projections adjacent to each other are arranged orderly in circumferential position. Therefore, sheets such as paper or hard films can be accurately fed in an intended direction while maintaining an accurate position. Further, according to the invention of claim 9, the rows or groups of projections adjacent to each other are deviated in position in the circumferential direction. Therefore, any of projections stick in sheets such as paper or hard films without fail, and it is possible to accurately feed them in an intended direction while maintaining an accurate position.

(9) In the projections, the end width is 10 to 500 $\mu$m, the end thickness is 1 to 300 $\mu$m, and the proximal width is 0.2 to 5.0 mm. Therefore, the contact or catching with respect to paper or sheets can be sufficiently increased. Accordingly, it is possible to accurately feed sheets such as paper or hard films in an intended direction while maintaining an accurate position.

(10) There are provided a support bed for supporting a metallic rod and a punch unit driven for reciprocation by a press arranged opposite to the support bed whereby a pair of perforating members formed on the face side where perforating edges are opposed to each other are detachably mounted on the punch unit. Therefore, it is possible to manufacture at a low cost a sheet feed shaft having spike-like projections of high feed effect of paper or films by the use of a simple perforating means.

(11) The metallic rod is supported on the support bed, two opposed portions of the peripheral surface of the metallic rod are simultaneously subjected to perforation processing by perforating members formed on the surface opposite to each other with perforating edges to form a plurality of spike-like projections whose rising directions are opposed to each other. Therefore, it is possible to form a number of spike-like projections of high feed effect of paper or film on the outer periphery of the metallic rod at the same time quickly and simply by the perforating processing making use of a press.

What is claimed is:

1. A method for manufacturing a sheet feed shaft comprising: supporting a metallic rod on a support bed, and simultaneously applying a perforating process to bristle a plurality of pairs of projections in which peripheral surfaces of tie metallic rod are opposed by a pair of perforating members formed with perforating edges on said peripheral surfaces opposed to each other to form a plurality of spike-shape portions whose bristled directions are opposite to each other, and in which are aligned along an longitudinal direction of said shaft and maintained a space of each other corresponding to a dimension of outside diameter of said metallic rod.

2. A method for forming a sheet feed shaft, the method comprising the steps of:

providing a metallic rod with a circumferential surface;

providing a pair of chisel members each with a plurality of knife edges aligned along an longitudinal direction of said shaft;

simultaneously forcing said knife edges into said circumferential surface at an angle substantially tangential to said surface of said rod, said knife edges being shaped and said forcing being performed to bristle and plastically deform said surface of said rod into a plurality of pairs of projections, said plurality of pairs of projections having a spike shape with an end point, said spike having a shape and said end point being sharply pointed to catch a sheet and to bite into the sheet causing feeding of the sheet.

3. A method in accordance with claim 2, wherein:

said forcing of said knife edges is performed, and said knife edges are shaped, to cause said projections to extend from said surface in opposite circumferential directions of said rod.

4. A method in accordance with claim 3, wherein:

said forcing of one of said knife edges into said circumferential surface is performed at an angle substantially tangential to said surface of said rod and in a circumferential direction of said rod substantially opposite to a circumferential direction of said forcing of another of said knife edges, said forcing of said one knife edge forming respective projections extending from said surface in a circumferential direction substantially opposite to circumferential directions of respective said projections formed by said another knife edge.

5. A method in accordance with claim 3, wherein:

said forcing of sad knife edges is performed, and said knife edges are shaped, to cause each of said plurality of projections to have a leading side and a trailing side with respect to said circumferential directions of said rod, said leading sides of alternating said projections curve toward said opposite circumferential directions of said rod.

6. A method in accordance with claim 5, wherein:

said forcing of said knife edges is performed, and said knife edges are shaped, to cause said trailing sides of said alternating projections to curve toward said opposite circumferential directions of said rod.

7. A method in accordance with claim 2, wherein:

said forcing of said knife edges is performed, and said knife edges are shaped, to cause each of said projections to form said end point in both a circumferential and longitudinal direction of said rod.

8. A method in accordance with claim 2, wherein:

said forcing is in a direction substantially circumferential to said rod.

9. A method for forming a sheet feed shaft, the method comprising the steps of:

providing a metallic rod with a circumferential surface;

providing a first chisel with a knife edge at a first side of said rod;

providing a second chisel with a knife edge at a second side of said rod, said second side of said rod being substantially diametrically opposite said first side of said rod;

simultaneously forcing said knife edges of said chisels into said circumferential surface of respective said sides of said rod at an angle substantially tangential to said surface of said rod, said knife edge being shaped and said forcing being performed to plastically deform said surface of said rod into a plurality of projections, said plurality of projections having a spike shape with an end point, said spike shape and said end point being sharply pointed to catch a sheet and to bite into the sheet causing feeding of the sheet, said forcing of said first chisel forming respective said projections extending from said circumferential surface in a first circumferential direction, said forcing of said second chisel forming respective said projections extending from said circumferential surface in a second circumferential direction, said second circumferential direction being substantially opposite said first circumferential direction.

10. A method in accordance with claim 9, wherein:

each of said knife edges of said first and second chisels have a plurality of perforating edges aligned in an longitudinal direction of said rod.

11. A method in accordance with claim 10, further comprising:

spacing each said perforating edges on a respective said chisel by a pitch;

arranging said perforating edges of said first chisel to be longitudinally spaced by substantially ½ of said pitch from said perforating edges of said second chisel.

12. A method in accordance with claim 9, wherein:

said forcing of said chisels is performed in a same direction on said opposite sides of said rod.

* * * * *